United States Patent [19]

Garrett

[11] 4,182,425

[45] Jan. 8, 1980

[54] REAMER

[75] Inventor: William R. Garrett, Houston, Tex.

[73] Assignee: Smith International, Inc., Houston, Tex.

[21] Appl. No.: 799,770

[22] Filed: May 23, 1977

[51] Int. Cl.[2] ..... E21B 9/08

[52] U.S. Cl. ..... 175/228; 175/347; 175/371

[58] Field of Search ..... 175/228, 344, 345, 346, 175/347, 342, 363, 366, 367, 368, 372, 334, 335, 325

[56] References Cited

U.S. PATENT DOCUMENTS

| | | | |
|---|---|---|---|
| 2,134,095 | 10/1938 | Abegg | 175/346 |
| 2,218,743 | 10/1940 | Catland | 175/346 |
| 2,498,756 | 2/1950 | Harris | 175/346 |
| 2,499,916 | 3/1950 | Harris | 175/346 X |
| 3,054,466 | 9/1962 | Wagnon et al. | 175/324 X |
| 3,627,068 | 12/1971 | Wagnon et al. | 175/347 |
| 3,907,048 | 9/1975 | Gray | 175/325 |
| 4,000,783 | 1/1977 | Hug | 175/346 |

*Primary Examiner*—James A. Leppink
*Assistant Examiner*—Richard E. Favreau
*Attorney, Agent, or Firm*—Murray Robinson; Ned L. Conley; David Alan Rose

[57] ABSTRACT

A roller on reamer's rollers are rotatably mounted on shafts whose ends are supported by blocks inserted in the reamer body. One end of each shaft is welded, pinned, or otherwise nonrotatably anchored to its mounting block. Each block makes an interference fit with the body socket in which it is disposed. The blocks are stepped or tapered for quick release. Access openings to the backs of the blocks facilitates knockout. Knockout of the stepped blocks is achieved by wedge means.

Drilling mud may have access to contacting surfaces of rollers and shafts to lubricate same. Protective seal means may be provided between each roller and shaft at the upper ends thereof so that the mud must flow upwardly to reach the space between shaft and roller and dense solids will be excluded by gravity. Grease lubrication may be provided, e.g. in conjunction with roller shafts mounted in stepped blocks, the rollers being sealed to the shafts at both ends. Tapered blocks facilitate sealing as required for air lubrication through the shafts.

With mud and air lubrication, axial loads in the rollers may be taken by the ends of the rollers bearing on the blocks. With protected mud lubrication and grease lubrication, thrust may be taken by thrust bearing surfaces provided within the protected or sealed zone, e.g. by a flange on each shaft engaging an internal groove formed by a two piece roller, or a ball lock between opposed annular grooves in shaft and roller.

104 Claims, 20 Drawing Figures

70
66
65
49
47
35
56
68
43
41
78
52
64
67
84
55
69
79
39
54
90
86
80
52
33
82
37
33
81
37
81
85
21
83
82
75
77
54
53
64
53
45
4
64
39
4
39
73
56
47
41
47
57
43
23
49
49

49A 41A
43A
75A
78A
79A
52A
93A
95A
96A
91A
97A
92A
54A'
82A'
77A
37A
33A
85A
83A
82A
54A
53A
73A
75A
39A
57A
78A
24A
56A
47A

49B 41B
43B
78B
128B
79B
52B
126B
75B
93B
91B
95B
96B
97B
54B'
92B
111B
121B
82B'
113B
105B
99B
107B
113B
98B
109B
115B
101B
103B
33B
85B
37B
83B
117B
77B
119B
82B
54B
53B
73B
75B
39B
57B
78B
56B
24B
47B

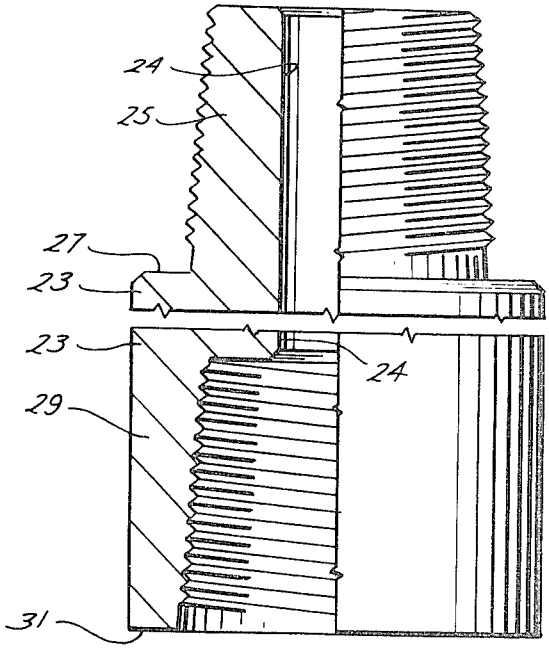
Fig. 2
Fig. 3
Fig. 6
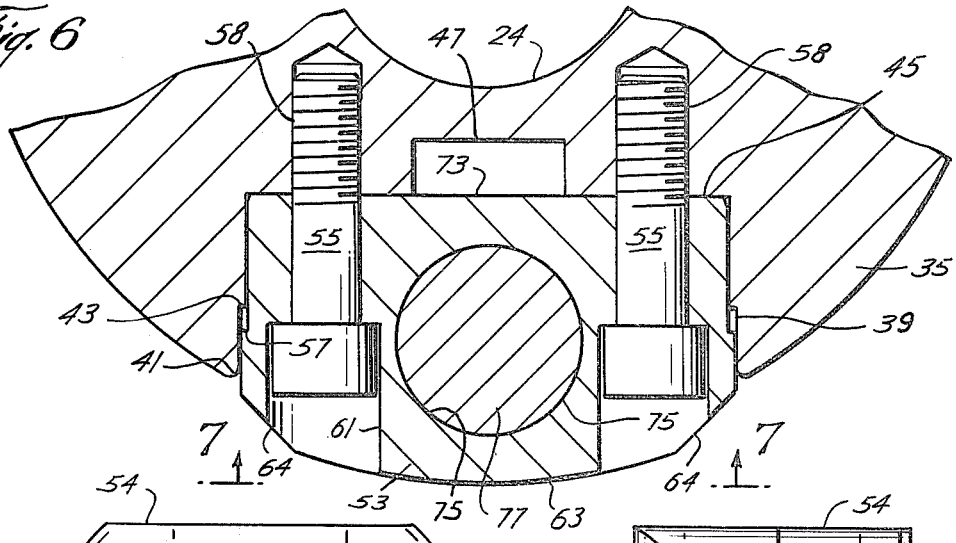
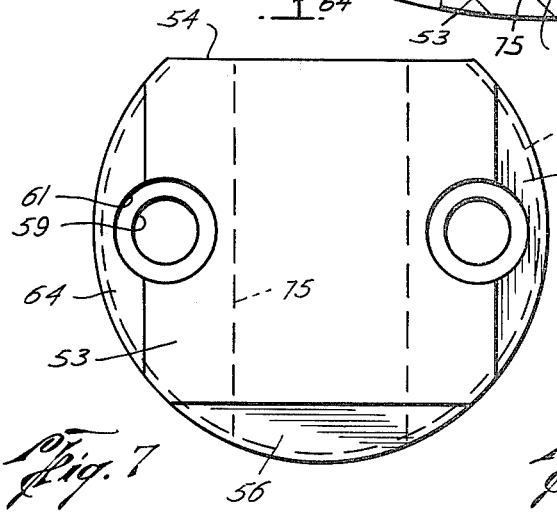
Fig. 7
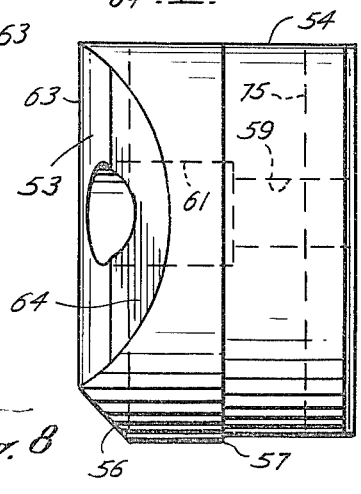
Fig. 8

9X
9X
9X
247
247
239
279
312
328
245
326
252
206
264
239
295
308
291
295
293
296
310
308
311
292
281
305
321
281
321
313
298
298
309
289
289
237
223
490
287
281
285
283
433
303
277
227
315
317
254
491
253
253
497
245
495
493
264
239
304
302
267
499
241
237
257
239
243
247
247

247A
239A
312A
279A
328A
326A
252A
206A
306A
308A
324A
295A
322A
310A
309A
298A
292A
293A
296A
300A
305A
311A
313A
290A
320A
233A
277A
283A
281A
285A
289A
287A
490A
315A
317A
324A
491A
253A
245A
493A
495A
304A
302A
247A 70C
66C
65C 49C
47C
68C
71C
39C
43C
41C
67C
51C
69C
52C
73
33C
81C
82C
9B
9B
53C
51C
64C
X
Y
Z
Z ≥ X
Z ≥ Y
47C
49C

REAMER

BACKGROUND OF THE INVENTION

This invention relates to earth boring and more particularly to roller reamers useful in the drill strings employed in the rotary system of drilling, either immediately above the drill bit or higher up in the string, e.g. between drill collars, for maintaining the hole full gage.

Conventional roller reamers employ a plurality of rollers each mounted to rotate on a shaft. Each shaft is mounted at the periphery of a body that is provided at its ends with threaded connectors for joining with other parts of a rotary drill string. The space between each roller and shaft is lubricated by the drilling fluid (air, water, mud, oil) passing through the body and back up the earth bore outside the body.

A. Prior Art Roller Reamers (i) In General

Roller reamers may employ smooth rollers, hard faced rollers, or rollers with milled teeth, as shown at page 1578 of the 1958-59 edition of the Composite Catalog of Oil Field Equipment and Services, or rollers with tungsten carbide teeth as shown at page 1602 of the 1966-67 edition of the same publication ("Knobby Reamer") and pages 1782, 1783 of the 1974/75 edition thereof and pages 2110-2114 of the 1976/77 edition thereof. The roller axes can be parallel to the body axis, as in the reamers referred to above and in U.S. Pat. No. 2,272,405—Grant (FIGS. 9 and 10), or coplanar but non-parallel as in FIG. 11 of said patent, or can be disposed with their axes non-coplanar with the body axis, as shown in FIGS. 12 and 13 of said patent and as shown at Page 1487 of the 1972/73 edition of the aforementioned catalogs.

U.S. Pat. Nos. 3,306,381—Garrett (parallel) 3,680,646—Huges & Garrett (non-coplanar) also illustrate roller reamers with parallel axis rollers and non-coplanar axis rollers. The Garrett patent further exemplifies inserted tungsten carbide tooth construction while the aforementioned Grant patent exemplifies milled tooth construction.

(ii) Bearings

Thrust washers at the ends of each roller are shown in U.S. Pat. Nos.:

1,654,609—Scott (infra)
1,983,315—Scott (infra)
2,035,888—Howard (infra)
2,093,603—Ellingsen (infra)
2,084,430—Catland (infra)
2,122,863—Howard et al U.S. Pat. Nos. 1,792,697—MacCotchie (infra) and, 2,154,553—Zublin disclose thrust flanges on the roller shafts at each end of each roller.

Roller radial bearings and thrust washers are shown by U.S. Pat. Nos. 2,128,416—Howard et al (infra), 2,272,405—Grant (supra), discloses a reamer having on each roller an inturned flange engaging a bearing sleeve flange disposed around the roller shaft, with and without radial and axial thrust roller bearings.

The use of radial roller bearings between each roller and shaft and the provision of ball thrust bearings between the upper end of each roller and a shaft flange is shown in U.S. Pat. No. 2,026,323—Reed (infra).

Radial roller bearings between each roller and shaft and ball thrust bearings between a shaft groove and a roller groove formed by a two piece welded roller is shown in U.S. Pat. Nos. 2,190,350—Catland (infra), 2,199,693—Catland (infra).

Similarly, in U.S. Pat. No. 2,218,743—Catland (infra), there is shown both radial roller bearing and ball thrust bearings, but the ball bearings are between each end of a roller and a bushing welded to the block.

U.S. Pat. No. 3,413,045—Wohlfeld (infra), shows roller bearings between roller and shaft disposed to take both axial thrust and radial load.

U.S. Pat. No. 3,897,837—Peterson (infra), shows radial a bearing sleeve and thrust bearing shoulders inside each roller bearing against a shaft shoulder and a collar around the shaft in the body.

B. Field Replaceable Rollers

It has been thought to be desirable to provide field replaceable rollers for roller reamers, so that the bodies can be saved after the rollers wear out. This is exemplified by the aforementioned patents and is typical of reamers used in drilling deep hard formation earth bores such as oil wells.

Other patents exemplifying such construction are U.S. Pat. Nos.:

1,654,609—Scott et al
1,723,380—Scott
1,766,578—Woods
1,792,697—MacClatchie
1,999,132—Reed
2,026,323—Reed
2,033,638—Koppl
2,128,416—Howard et al
2,172,762—Koppl
2,189,034—Harrington
2,189,035—Squires
2,210,824—Walker, Sr.
2,698,738—Turner.

Typically each roller shaft is mounted in a block releasably secured to the reamer body. Sometimes the blocks are rectangular. In other cases they are trapezoidal in horizontal section, being dovetailed to the body, as in U.S. Pat. Nos.:

2,122,763—Smith
2,189,036—Jones
2,189,037—Harrington
2,189,038—Jones
2,189,040—Jones
2,234,219—Anderson
2,260,366—Childs
2,306,492—Noble
2,716,020—Blaker.

Sometimes provision is made for driving the shafts out of the rollers and blocks to release same, the reamer body being provided with grooves to allow access for drive tools, e.g. as shown in some of U.S. Pat. Nos.

1,983,315—Scott
2,035,888—Howard
2,093,603—Ellingsen
2,189,031—Harrington
2,189,032—Carleton
2,189,033—Book et al
2,695,042—Donley.

Sometimes the blocks supporting the shafts are cylindrical, as shown in U.S. Pat. Nos.

2,084,430—Catland
2,190,350—Catland
2,199,693—Catland
2,218,743—Catland.

Also, the use of stepped cylindrical members of various kinds is disclosed in some measure in U.S. Pat. Nos. 2,498,756—Harris 2,499,916—Harris, and retaining screws with conical head portions are shown in U.S. Pat. No. 1,878,114—Crickmer.

The use of both screw jacks and drive off tools for separating pin and socket members is also known in connection with the removal of pump pistons from piston rods and in dentistry in the removal of crowns from teeth.

C. Lubrication

Especially since the introduction of tungsten carbide inserted teeth for the roller cutters, it is not always the cutters which wear out first. Sometimes it is the bearings and sometimes it is the body that first wears out.

In connection with the drilling of shallow holes in unconsolidated formations, e.g. blast holes, it has been known to increase bearing life of the rollers by air lubrication of the roller shafts, with air bled from the drill string, and to provide long lasting but inexpensive fabricated bodies which can be thrown away when the rollers are worn out. This is disclosed by U.S. Pat. Nos.

3,303,900—Kloesel, Jr. et al (air lubrication)
3,306,379—Kloesel, Jr., et al (fabricated body)
3,494,432—Garrett (now Re 27,791) (hollow pins)
3,820,613—White (cup shaped bearing blocks).

Reamer life has heretofore exceeded bit life, especially in the case of reamers employing rollers with inserted tungsten carbide teeth. When drilling deep hard formation wells, whenever the drill string was removed to replace the bit, the reamer rollers could be replaced and the reamer expected to last as long as the new bit. The body would last indefinitely.

Recently, drill bits have been provided with sealed lubricated bearings. See, for example, U.S. Pat. No. 3,463,270—Lundstrom et al, and the 1974/75 edition of the aforementioned catalog pages 4576-4577, Smith Tool Company. The use of sealed lubricated bearings has greatly increased the life of bits. In boring deep holes, the use of such bits reduces the number of expensive trips in and out of the hole required for changing the drill bit. The life of sealed lubricated drill bits may be 200 hours and now exceeds the life of conventional reamer bearings, which may last only 100 hours. This means either that the bore goes undergage during the last 100 hours of each bit's life, due to inward movement of the rollers on the worn down bearings, or else that the drill string must be pulled to replace the rollers and shafts of the reamer even though the bit is still good.

It has heretofore been disclosed that sealed lubricated bearings may be used not only for drill bits but roller reamers and stabilizers. See for example U.S. Pat. Nos. 3,413,045—Wohlfeld (stabilizer) 3,897,837—Peterson (reamer), and U.S. patent applications filed Sept. 7, 1976 assigned to the same assignee as the present application, Ser. Nos.

720,695—Kellner
720,954—Young
721,089—Kellner
721,090—Kellner.

D. Mining Tools

The "Industrial Products" catalog (Q1073) of DRILCO a division of Smith International, Inc., assignee of the present application, shows roller stabilizers used in mining, e.g. at page 5 (air lubrication, page 6 (welded in and torch removed blocks), page 7 (blocks force fitted in body, shaft secured to lower block by roll pin, tool used to drive shaft from upper block and roller, page 13 (stabilizer is a reamer), page 18 (big hole reamer and stabilizer), page 20 (water well reamer-stabilizer).

It is an object of the present invention to provide a roller reamer with more easily replaceable rollers and shafts and with improved means for removing the shaft mounting blocks from the body, to enable the body to be saved and reused, and to provide improved means for anchoring the shafts against rotation with the rollers whereby the shafts can be reused by turning them 180 degrees when worn on one side, and to provide a lubricated roller reamer to enhance bearing life, the bearings for the rollers being lubricated according to the intended field of use, e.g. with special lubricant such as grease or with drilling fluid derived either from inside the reamer, e.g. air, or from the earth bore around the reamer, e.g. mud, and to provide improved sealing means to control the lubricant flow, to prevent loss of special lubricant, and to exclude abrasive solids, and to provide improved thrust bearings for a reamer roller which can be better lubricated and to provide a reamer that is lubricated in a factory environment where vacuum can be used, and having lubricated thrust bearings, and which can not sand up over the seals.

Other objects and advantages of the invention will appear hereinafter.

BRIEF DESCRIPTION OF THE DRAWINGS

For detailed descriptions of preferred embodiments of the invention, reference will now be made to the following drawings wherein:

FIGS. 2 and 3 are fragmentary elevations of connection means suitable for the reamer;

FIG. 6 is a fragmentary section taken at plane 6—6 of FIG. 1 showing the reamer body with roller shafts and blocks in place;

FIG. 7 is a front elevation of a block, as viewed at 7—7 in FIG. 6;

FIG. 8 is a side elevation of a block;

DESCRIPTION OF PREFERRED EMBODIMENTS

I. First Embodiment

Figure 1:
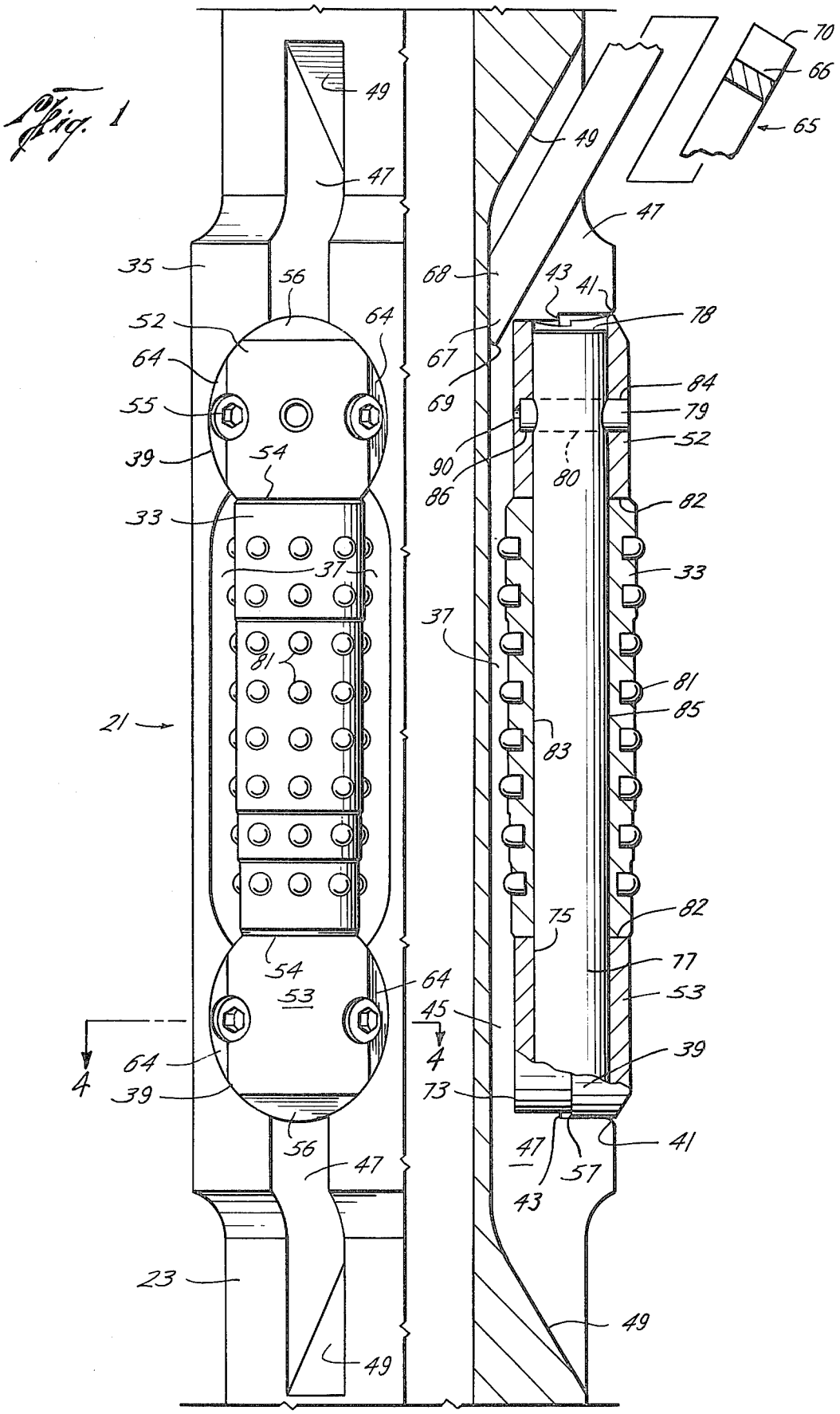
FIG. 1 is a fragmentary half section through an annulus fluid lubricated reamer embodying the invention.

Referring now to FIG. 1 there is shown a reamer 21 comprising a generally cylindrical tubular body 23 having a flow passage 24 extending axially therethrough. Means for making rotary shouldered connections with adjacent drill string members are provided at the upper and lower ends of the body, e.g. a tapered threaded pin 25 and shoulder 27 at the top and a correlative box 29 with shoulder 31 at the bottom, as shown in FIGS. 2 and 3. This arrangement is suitable for a reamer to be run between drill collar and drill bit. If the reamer is to be used higher up in the drill string, the box would be at the top and the pin at the bottom, but the remainder of the reamer would be disposed as shown in FIG. 1, i.e. with the reamer rollers 33 positioned with their largest diameter ends at the top. This result can be effected using only one style of reamer body by reversing the rollers during assembly if the top and bottom halves of body 23 are made identical except for the rotary shouldered connections. For a further disclosure of rotary shouldered connections see U.S. Pat. No. 3,754,609—Garrett.

Figure 4:
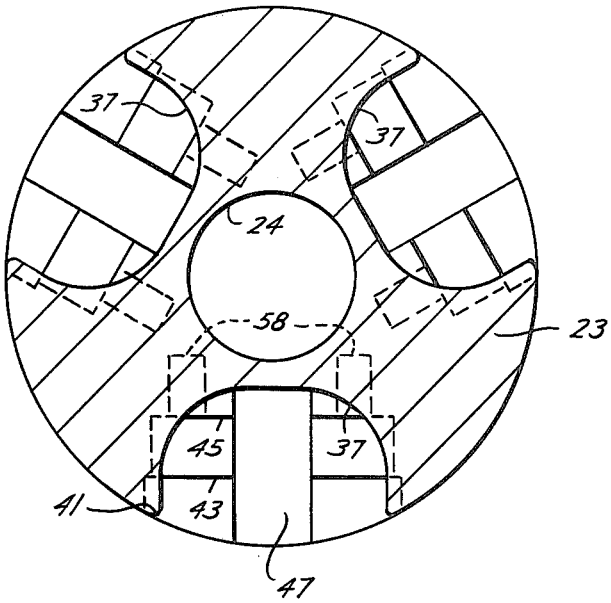
FIG. 4 is a section taken at plane 4—4 of FIG. 5, showing the reamer body alone.
Figure 5:
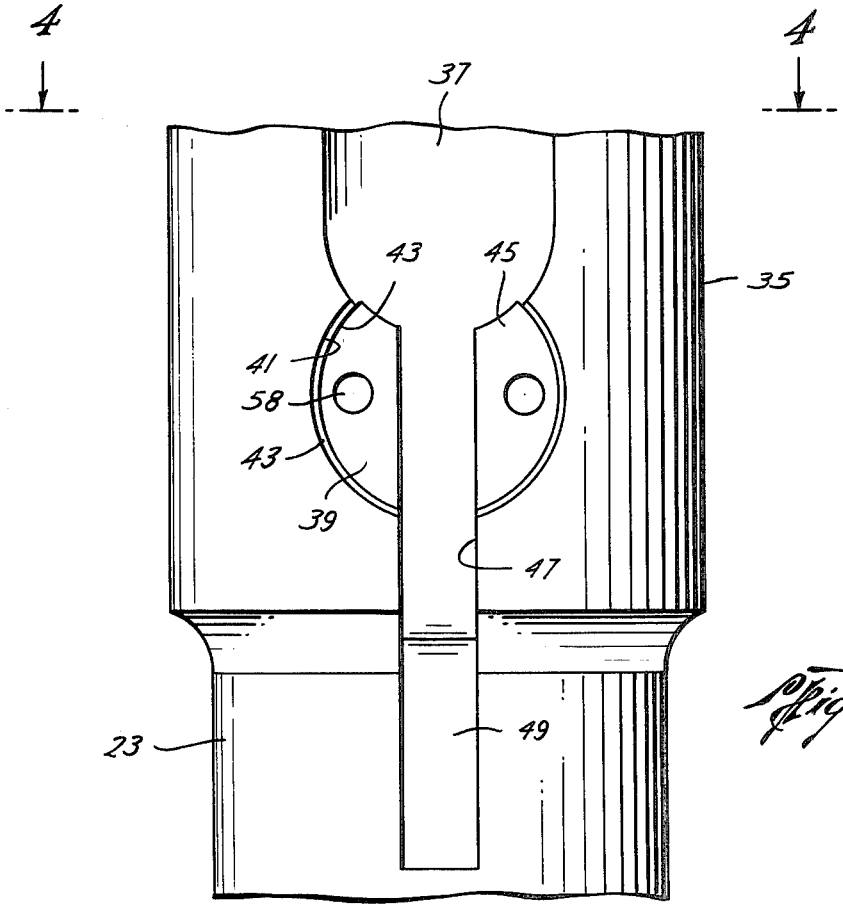
FIG. 5 is a fragmentary elevation of the reamer body.

Referring once more to FIG. 1, and to FIGS. 4 and 5, the mid-portion 35 of body 23 is of larger diameter than the ends adjacent connector means 25–27, 29–31. Within the enlarged portion 35 are formed plurality, e.g. three elongated roller pockets 37. At the upper and lower ends of each pocket are formed block sockets 39. Sockets 39 are generally cylindrical but have reliefs 41 around their mouths and steps in their side walls at 43. The inner ends 45 of the sockets are flat, except where transected by slots 47 which extend from each end of pocket 37. The extreme ends of slots 47 are sloping, as shown at 49.

Referring now also to FIGS. 6–8, received within the block sockets 39 are upper and lower blocks 52, 53. The blocks are generally cylindrical plugs but have flat, side portions 54 adjacent sockets 37 and bevels 56 at their opposite sides. The cylindrical side walls of the blocks are stepped at 57 and the parts of the side walls above and below the steps are correlative to the sides of the sockets but the steps do not engage. The blocks made a drive fit with the sockets. The step construction allows easy centering and axial alignment (no canting) before a block is driven into its socket. This avoids broaching the socket as may occur in the case of driving in a canted or otherwise misaligned block. Such broaching is undesirable since it will interfere with proper positioning when the block is removed and replaced and may make removal and replacement with a new block more difficult.

Two cap screws 55 hold each block to the body after the block is driven into place. Threaded bores 57 are provided in the body to receive these screws, and the blocks are provided with unthreaded holes 59 countersunk at 61 through which the screws extend. The heads of the screws are within the envelope of the outer surface 63 of each block, the outer surface 63 being cylindrically curved concentric to the curvature of body portion 35. Outer surface 63 extend beyond the outer periphery of body portion 35 and is provided with lateral bevels 64 merging with body portion 35. Bevels 64 guide the blocks over rough protuberant portions in the bore hole as the reamer rotates therein. This is similar to the purpose of bevels 56 which guide the blocks over such protuberances when the reamer is raised or lowered.

When it is desired to remove blocks 53, the cap screws are removed first. The blocks are then forced out with tool 65. Tool 65 includes a handle 66 and a head 68.

The tool is a bar of rectangular cross section and is cut off or beveled at an angle at 67. The angle between bevel 67 and the length of handle 66 is equal to the slope of slot portion 49, the head 68 being wedge shaped in side elevation. The tip 69 of the tool may be rounded. The wedge shaped head of the tool is placed in slot 47 with tip 69 beneath a block. Blows are then struck on the handle end 70 of the tool. This forces the wedge head 68 under the block against its flat under surface 73. The use of wedging action to remove the blocks gives sufficient mechanical advantage to make block removal easy despite the drive fits. When the bottom of a block passes the step in its socket the block is free even though only part way out of the socket. Thereafter the tool can be used as a lever to push the block all the way out of the socket.

The blocks are provided with cylindrical bores 75 in which are received axles or shafts 77. The shafts have flat ends 78. To prevent the shafts from rotating with the rollers, one end of each shaft 77, e.g. the upper end, is secured to one of the blocks, e.g. 52, by a roll pin 77 passing through a hole 80 in the upper end of the shaft and registering holes 84, 86 in the block, hole 86 having a shoulder 90 to limit the entrance of the roll pin. The roll pin makes an interference (drive) fit within or more of holes 80, 84, 86, to hold it in place. The pins are driven or pressed with place when the shafts becomes worn, the roll pins can be removed and the shafts turned 180 degrees prior to reassembly, thereby to present new, full gage surfaces to support the rollers; alternatively as will be described in connection with FIG. 1B, one end of each shaft could be welded to its block, but then it would have to be replaced whenever the shaft is replaced.

The other end of each shaft makes a close fit (snug or slight clearance) with the bore 75 in block 53. This provides firm support but allows the blocks to rock about the shaft axis, and to shift in the direction of the shaft axis, relative to each other, as may be necessary to fit into the sockets 39, but positively retains the shafts within the blocks.

On the shafts 77 are rotatably mounted the rollers or cutters 33. The rollers are stepped and provided with rows of inserted tungsten carbide teeth 81, e.g. as in the aforementioned Garrett U.S. Pat. No. 3,306,381. Other types of earth formation reducing means, e.g. milled teeth or "Q" cutters, as previously mentioned, may be employed.

The ends of the rollers are flat, as indicated at 82, to provide thrust bearing surfaces cooperating with the flat thrust bearing surfaces 54 on the blocks 53. Each roller is a little shorter than the space between the surfaces 54 of the blocks which support its shaft, leaving a little clearance where drilling fluid outside the reamer can enter and lubricate the thrust bearing surfaces 54, 82, and also the radial bearing surfaces 83, 85 provided by the cylindrical bores 83 of the rollers and the cylindrical outer peripheries 85 of the shafts 75.

Note that the drilling fluid inside the reamer flows through body passage 24 from the threaded box to the threaded pin without contacting the reamer rollers, which are located in the pockets on the exterior of the body; it is only drilling fluid flowing outside the reamer that lubricates the bearings.

The foregoing construction is well suited for drilling with bits whose life is not likely to exceed that of the reaming and bearing surfaces of the reamer rollers, so that no extra trips need be made just to change rollers. For example, the construction is suitable for use with bits not having sealed bearings. Whenever the rollers and shafts do wear out, they are easily replaced because of the special construction of the shaft blocks, and the body is thereby saved and reused. If not worn out the blocks or shafts or both can be reused when the rollers are replaced. As mentioned above, the shafts can be turned 180 degrees when replaced, thereby presenting new, full gage, bearing surfaces to the rollers, since it is the outer portions of the shafts which contact the inner surface of the rollers.

Since the rollers shafts are mounted in holes in blocks set into sockets in the reamer body, the body can be made in one piece. In other words, the end portions of the body, whereat are located the connector means shown in FIGS. 2 and 3 and the sockets 39 receiving the blocks 53, can be made of one piece with the intermediate portion of the body containing roller pockets 37. There is no need to weld or otherwise integrate the end portions with the intermediate portion connecting same. The intermediate portion transmits torque, axil force, and bending moment between the end portions, reducing the strain on the shafts and blocks.

Modification "A" of First Embodiment

Figure 1A:
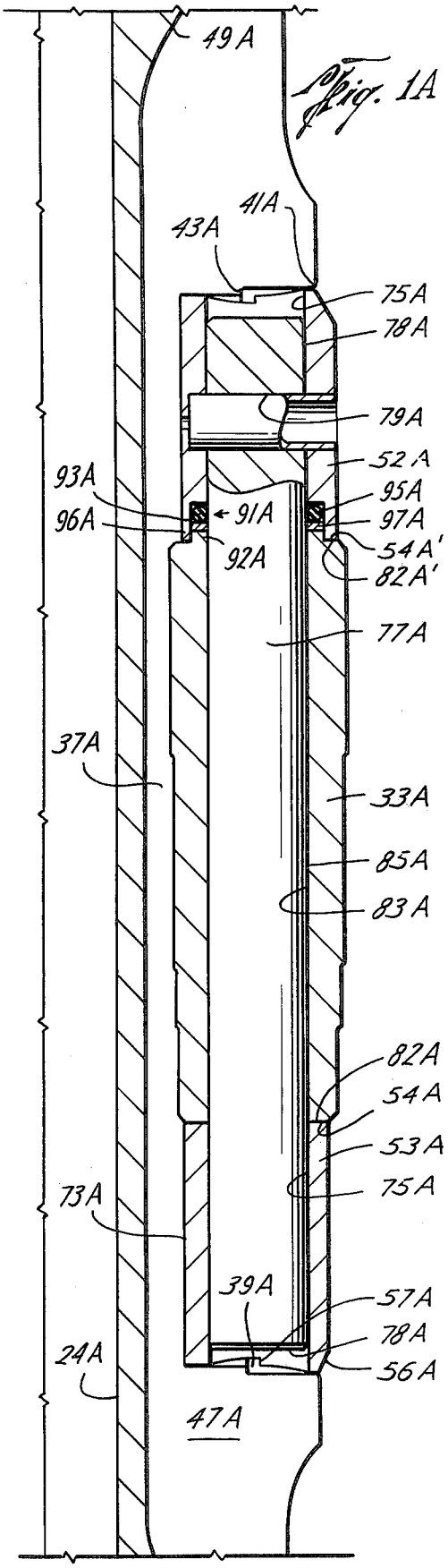
FIGS. 1A and 1B are fragmentary half sections similar to the right hand portion of FIG. 1 and showing modifications of the embodiment of FIGS. 1-8.

Referring now to FIG. 1A there is shown a modification of the construction shown in FIGS. 1–5. In FIG. 1A, parts similar to those shown in FIGS. 1–5 are numbered the same as in FIGS. 1–5 except having the suffix "A"; this shows the correlation with the previously described construction and eliminates the need for repeated description. Generally the FIG. 1A construction is the same as that of FIG. 1. For simplicity, roller **33*a* has been shown as being a smooth roller, but it will be understood that for most purposes rollers provided with inserted tungsten carbide teeth will be employed, the same as in FIG. 1**; also, milled teeth or other earth formation reducing means may be employed.

The FIG. 1A construction differs from the FIG. 1 construction in the provision of rotating seal means 91A between the upper part of the shaft and the roller to prevent entrance of sand laden drilling mud between the radial load bearing surfaces of the shaft and roller, namely the cylindrical outer periphery 85A of shaft 75A and cylindrical bore 83A of roller 33A. The only drilling mud which gets between surfaces 83A and 85A is relatively clean drilling mud flowing upwardly after entering between lower thrust bearing surfaces 82A, 54A. Sand and other dense abrasive materials will lend to fall out of such drilling mud under the influence of gravity. The cleaner drilling mud thus provided for the radial load bearing surfaces 83A, 85A will better lubricate these surfaces and cause less wear, so that the bearing can last longer.

Seal means 91A is disposed in an annular pocket formed between an annular groove 93A the flat lower side of block 52A and an annular tongue 92A on the upper end of roller 33A. The outer wall of the groove forms a skirt 96A extending down and overlapping tongue 92A. Within this pocket are disposed O-ring 95A and flat washer 97A. O-ring 95A is preferably made of nitrile rubber or other oil and water resistant elastomeric sealing material. Washer 97A is preferably made of hard wear and corrosion resisting metal such as Stellite O ring 95A seals between block 52A and washer 97A and presses the washer to sealing engagement with the upper end of tongue 92A. In operation, the O-ring and washer will normally not rotate within groove 93A, wear being taken between the washer and the roller tongue. Since skirt 96A overlaps the outside of tongue 92A, sand is excluded from the relatively moving surfaces of the washer and tongue to prolong their life.

As in the FIG. 1 embodiment, axial load on roller 33A is taken by the thrust bearing surfaces 54A, 84A at the lower end of the roller. Usually a roller tends to ream faster than the bit bores the hole so that the roller bears down against the lower block. However, in the event of upward force of the roller against the upper block, the thrust bearing surface 54A' and 82A' outside of groove 93A and tongue 92A are sufficient to take the load.

Modification "B" of First Embodiment

Figure 1B:
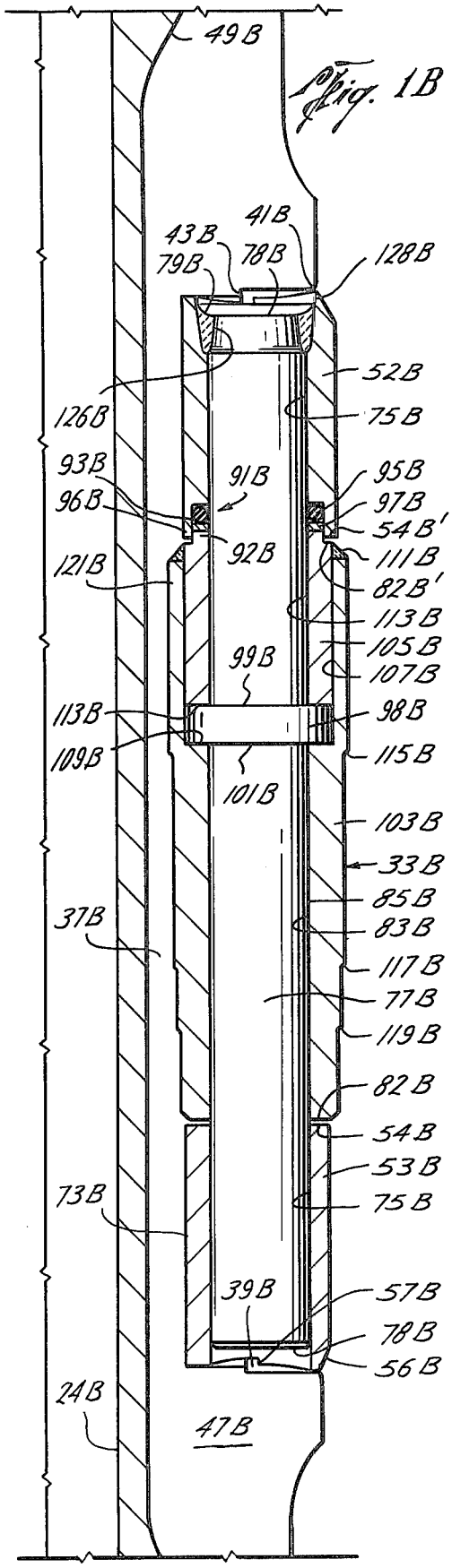

FIG. 1B illustrates a further modification of the first embodiment of the invention. Parts which are the same as or similar to those of the first embodiment or modification "A" thereof are given the same numbers except using the suffix "B". As in the FIG. 1A modification, the inserted carbide teeth of the FIG. 1 embodiment are omitted for clarity, but it will be understood that same will ordinarily be employed rather than using a smooth roller.

In the FIG. 1B construction, the roll pin of the FIG. 1A construction is shown to be omitted, and upper block 52B does not have any holes to receive a roll pin. Also, there is no hole in the upper end of shaft 77B to receive a roll pin. Shaft 77B is shown to be secured to one of the blocks, e.g. upper block 52B, by welding, as indicated at 79B. To facilitate such welding the upper end of shaft 75B is conically tapered at 126B and the inner periphery of block 52B is conically bevelled at 128B. This forms an annular groove to receive the weld metal. This welded construction provides a stronger connection between the shaft and block than does the roll pin of the previously described constructions. Such added strength is desirable when the shaft takes axial thrust loads as will next be described.

In the FIG 1B embodiment axial thrust is not taken by the flat sides 54B, 54B' of the blocks, these surfaces being spaced slightly from the adjacent end surfaces 82B, 82B' of the roller. Instead, shaft 77B is provided with an annular thrust flange 98B having flat upper and lower bearing surfaces 99B, 101B. To receive the flange, roller 33B is made up of two parts 103B, 105B. Flange 98B is disposed in a counterbore 107B in the upper end of principal part 103B of roller 33B and its lower bearing surface 101B engages bearing surface 109B formed by the upwardly facing shoulder at the juncture of roller bore 83B and the larger diameter counterbore 107B. Part 105B of roller 33B is a tubular bushing telescopically snugly received in counterbore 107B. Bushing part 105B is welded to principal part 103B of the roller at 111B. Upper bearing surface 99B of the flange engages bearing surface 113B formed by the lower end of bushing part 105B.

With the modified construction of FIG. 1B, the thrust bearing surfaces 99B, 101B of the shaft and 109B, 113B of the roller are within the zone protected by seal means 91B from abrasive laden drilling mud, the same as the cylindrical radial load bearing surfaces 83B and 85B of the roller parts 103B, 105B and the cylindrical radial load bearing surface 85B of shaft 77B on which the roller turns. With all bearing surfaces within the protected zone, the roller and shaft will be less subject to wear.

It is also to be noted that roller 33B is stepped, i.e. of different diameters at different positions along its length. This positions, its cutter teeth (not shown in FIG. 1B but shown at 81 in FIG. 1) at different radial distances from the roller axis so as to cause the reamer action to be distributed along the lengths of the rollers. The steps are indicated at 115B, 117B, 119B. Roller shoulder 109B, against which shaft flange 98B bears, is located above step 115B in the upper, largest diameter portion of the roller so that the wall 121B of the counterbored part of roller portion 105B can be as thick and strong as possible.

II. Second Embodiment

Figure 9:
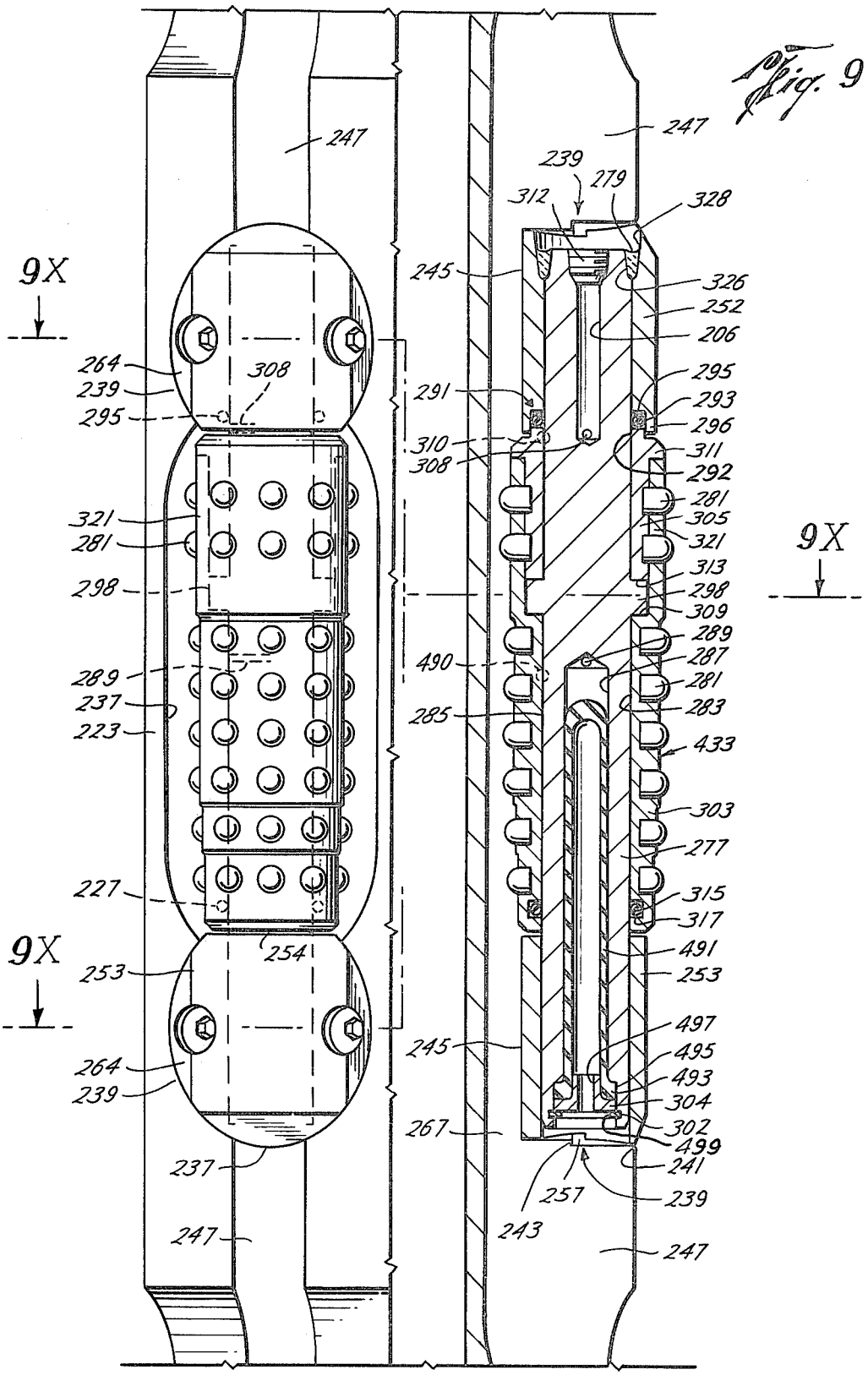
FIG. 9 is a fragmentary half section through a reamer according to another embodiment of the invention employing grease lubrication.
Figure 9A:
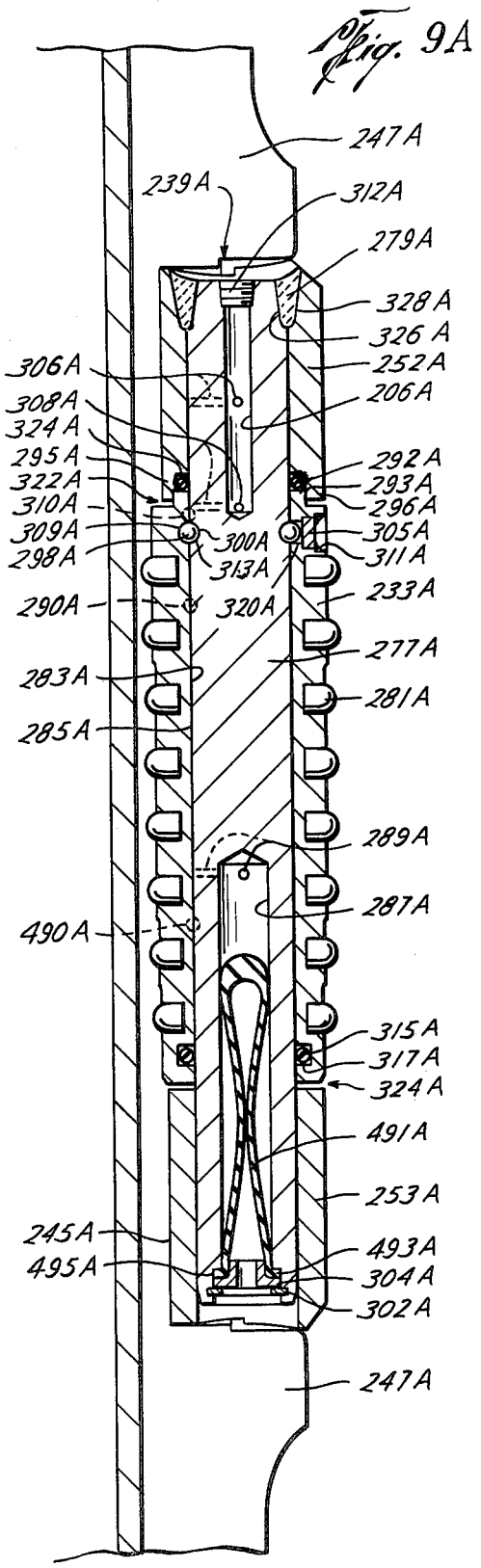
FIG. 9A is a view similar to the sectioned portion of FIG. 9 showing a modification employing ball thrust bearings.
Figure 9C:
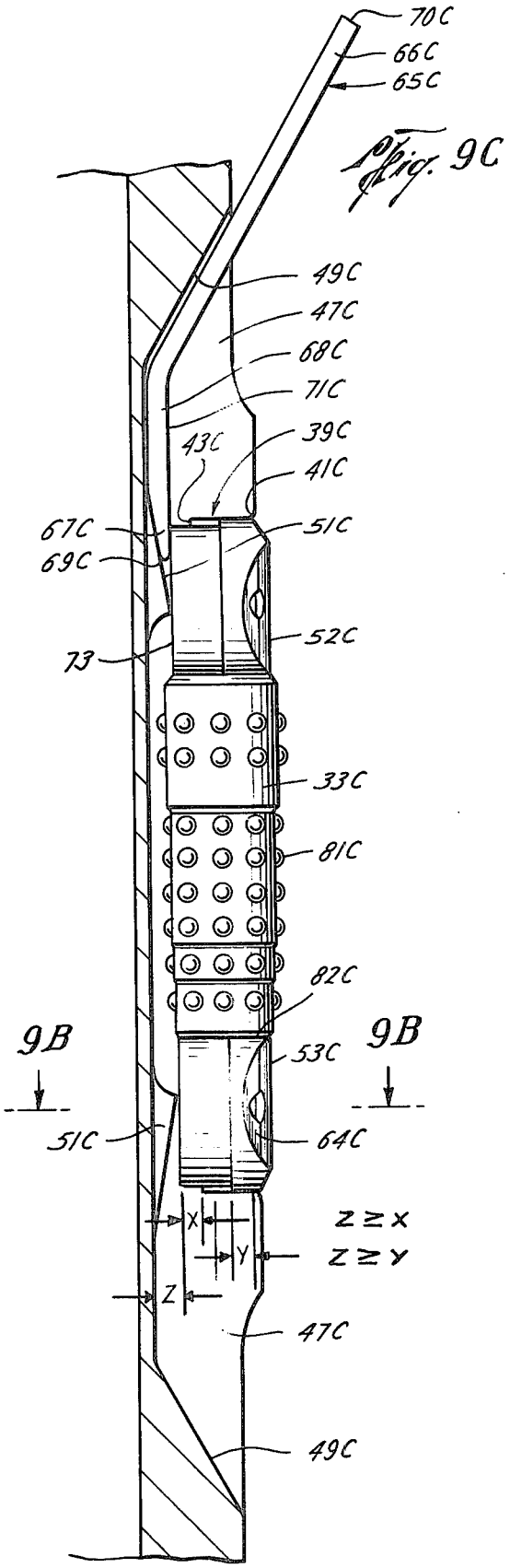
FIG. 9C is fragmentary vertical section through a reamer showing a modification employing a ramp to cooperate with a block removal tool.
Figure 9B:
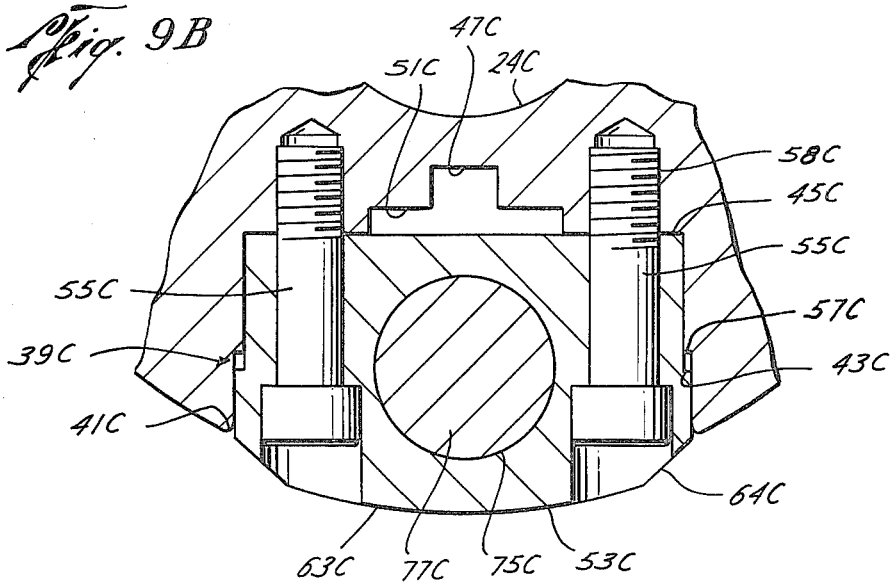
FIG. 9B is a section taken a plane 9B—9B of FIG. 9C.
Figure 9X:
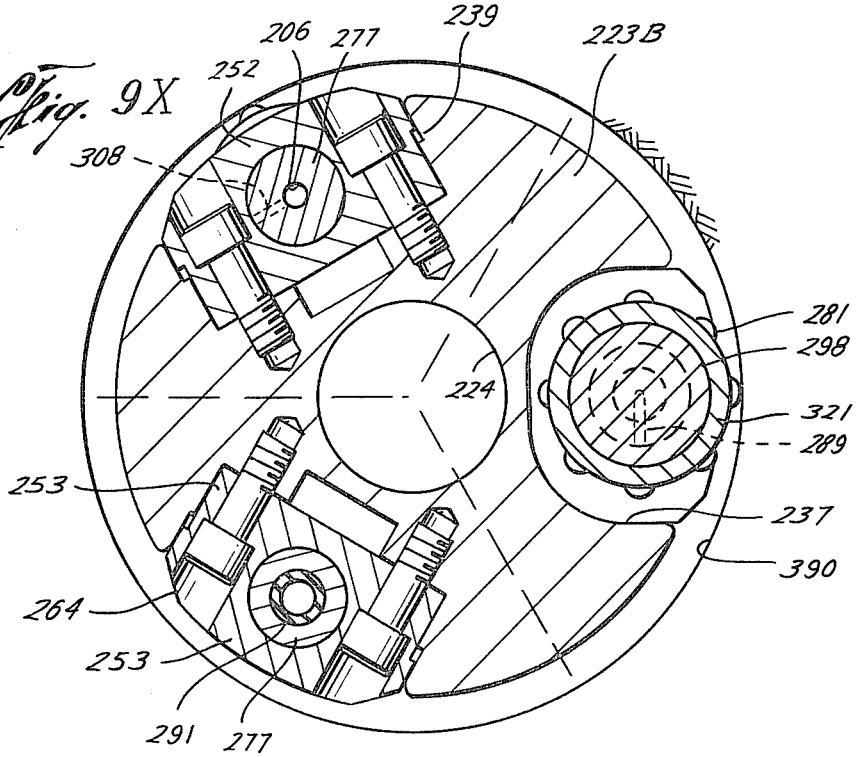
FIG.9X is a section taken at planes indicated at 9X—9X—9X, of FIG. 9.

Referring now to FIGS. 9 and 9X, there is shown a modification of the reamer in which provision is made for lubricating the roller and shaft bearing surfaces with grease. Except for this change, the construction is practically the same as that shown in FIG. 1B and the description thereof need not be repeated. Parts that correspond to those of the construction of the first embodiments are given like numbers plus 200.

Each shaft 277 is provided with a reservoir, formed by an axial bore 287, which is filled with grease. A radial port 289 conveys the grease to the space 290 between the principal roller part 303 and shaft 277 to lubricate the radial bearing surfaces 283, 285.

A flexible diaphragm 491, which may be a tubular rubber sack, is disposed in one end of bore 287. The sack has its mouth or rim 493 resting in annular recess 495 in bore 287. Reinforcement tube 497, made of some rigid material is disposed in the mouth of the sack. A snap ring 499 is disposed in annular groove 302 in the end of shaft bore 287. Ring 499 bears against flange 304 on tube 497 to hold rim 493 of sack 491 in recess 495. The central openings through snap ring 499 and tube 497 allow drilling fluid to contact diaphragm 491 for pressure equalization. If desired, a screen or other foraminous member may be placed in the center of flange 304 to filter the drilling fluid and keep detritus away from the diaphragm.

Each shaft is provided at its other end with a smaller diameter passage 206 communicating through radial port 308 to space 310 between roller bushing 205 and the upper part of shaft 277. Space 310 communicates with space 490 via the space around flange 298. By this means bore 483 can be filled with grease by injection into passage 206. The end of passage 206 is releasably closed by a threaded seal plug 312, the inner periphery of the latter having a hexagonal cross-section to receive a hexagonal wrench. Before filling the bore with grease, it can first be evacuated of air by suitable means (not shown), both ends of the bore being evacuated to prevent rupture of the diaphragm. A tee fitting can be used for first evacuating the air, then holding the vacuum, and then filling with grease.

Between the upper end of each roller and shaft is provided seal means 295 which may be the same as seal means 91A, 91B previously described or, since the O-ring is greased, the metal washer may be omitted, as shown, O-ring 295 forming a rotating seal. O-ring seal 315 received in annular groove 317 in roller part 303 seals between roller 303 and the lower end of shaft 277. These seals keep the grease from flowing out of the annular spaces between the roller and shaft.

As in the modification of FIG. 1B, sealing arrangement 291 at the top of each roller of the FIG. 9 construction comprises downwardly opening recess 293 forming a skirt 296 around the outside of neck 292, with seal 295 therebetween. This construction is provided to keep out sand which might otherwise, leak past the seal 295, and fill up the annular spaces between roller and shaft. For comparison consider the case of well pumps which often sand up and become inoperative even though sealed. The point is that the seal must be at the upper end of the space to be sealed, i.e. the sand must be made to travel upwardly, against gravity, to get to and through the seal.

As in the other embodiments described hereinbefore and hereafter, the O-ring seals may be made of an oil and water resistant elastomer such as nitrile, and the rollers are made of steel, as are the shafts, blocks and body. The description applied to the single roller and shafts shown in FIG. 9 (and also FIGS. 1A and 1B) applies to course to all three rollers and shafts of the reamer.

In the FIG. 9 embodiment, one further difference needs to be mentioned. Instead of a weld 111 between bushing 305 and the upper end of wall 321, there is provided at the upper end of bushing 305 an outturned radial flange 311 which overlies the upper end of wall 321 and is engaged therewith. Reliance is placed upon a press fit between bushing 305 and wall 321 to hold these parts together. Also, since tungsten carbide inserts 281 extend through wall 321 into bushing 305 (as they would also in the FIG. 1B modification), they function as pins providing means interlocking the roller parts (bushing and wall) to prevent their separation. If desired, the FIG. 9 construction could also incorporate a weld between bushing and roller wall. Also, in the FIG. 1B construction, the weld could be supplemented by a press fit. In either modification, any one or more of the three connecting means (weld, press fit, pins) can be employed.

Modification "A" of Second Embodiment

Referring now to FIG. 9A there is shown a modification of the FIG. 9 construction in which ball bearings are substituted for the thrust flange on each roller. Except for this change, the FIG. 9A construction is substantially the same as that of FIG. 9. Therefore like parts are given the same numbers with an "A" suffix, and with this correlation the entire description need not be repeated. Only the difference will be described in detail.

Thrust bearing balls 298A are disposed in the ball race 300A formed by annular groove 309A inside roller 233A and annular groove 313A in the outer periphery of shaft 277A. The balls are inserted into race 300A through a radial port 320A in the side of roller 233A. The port is then closed by plug 305A, seated against an annular shoulder in port 320A and held in place by a weld bead 311A.

The FIG. 9A construction also illustrates the use of a pressure balancing vent to the inner upper side of O-ring 295A. Such vent is provided by radial port 306A extending from grease passage 206A to the outer periphery of shaft 277A. Preferably port 306A is azimuthally positioned as shown in the neutral stress zone of shaft 277A, as are ports 308A and 289A. As shown on dotted lines, additional or alternative ports 289A, 308A, 309A extending inward toward the reamer axis in a diametral plane could be employed; but greater strength is achieved with those ports in the neutral zone.

It will be seen that by virtue of vent port 306A, the upper inside surface of O-ring 295A is exposed to the same grease pressure as is the lower inside surface of the O-ring by virtue of grease passage 308A. Since the grease reservoir 287A is at ambient drilling fluid pressure due to one wall of the reservoir being formed by pressure equalizing flexible diaphragm 291A, the internal pressures on the O-ring are the same as that on the exterior thereof. The exterior of O-ring 295A is exposed to ambient drilling fluid pressure through the roller end clearance space 322A and the clearance between annular tongue or lip 292A on the roller and skirt 296A on the block.

The triple pressure balance on O-ring 295A is desirable because O-ring 295 seals at three places, i.e., around shaft 277A, around the flat top surface of roller tongue and around the flat surface 324A at the bottom of the socket in block 252A. In contrast, O-ring 315A at the lower end of the roller seals at only two places, i.e. around the outer periphery of shaft 277A and to the annular groove 317A in the lower end of roller 277A. O-ring 315A is exposed to ambient drilling fluid pressure through roller and clearance 324A and to like grease pressure through annular clearance 290A between roller and shaft.

FIG. 9A illustrates diaphragm 491A in a partially collapsed condition. Such collapse occurs when grease is introduced into reservoir 287A. FIG. 9 shows diaphragm 491 in the relaxed condition just after reamer assembly but prior to putting grease in the reservoir.

FIG. 9A also shows that filler passage plug 312A to be of smaller diameter than plug 312 of FIG. 9. It is only necessary that the threaded mouth of grease inlet passage 206A be of such a size as to receive the end of a grease gun tube or other suitable filling apparatus.

Body Modification Of First and Second Embodiments

The same reamer body 23 is used in the embodiments of FIGS. 1 and 9 and the several modifications of FIGS. 1A, 1B, 9A, and 9B. A reamer with a modified body construction is shown in FIGS. 9C and 9B. Parts which are similar to those of the previously described constructions are given the same numbers as in FIG. 1 with a "C" suffix; with this correlation only the differences need be described.

Underneath each block socket 39C at each side of slot 47C are ramps 51C, which extend up to the end of socket bottom 45C. When it is desired to remove blocks 52C, 53C, the cap screws 55C are removed first. The blocks are then forced out with tool 65C.

Figure 14:
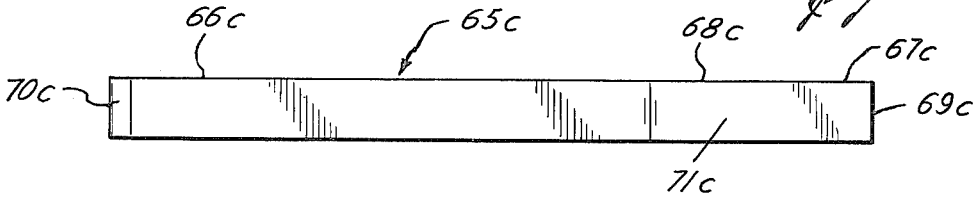
FIG. 14 is a top view of a knockout bar according to the invention.

Tool 65C includes a handle 66C and a head 68C. The tool, shown also in FIG. 14, is a bar of rectangular cross-section with head end 68C bent at an angle equal to the slope of slot portion 49C, the head 68C being wedge shaped in side elevation, as shown in FIG. 9C. The point 69C of the tool is rounded.

The wedge shaped tip 67C of the tool is placed on the ramp 51C beneath a block. Blows are then struck on the handle end 70C of the tool. This forces the wedge tip 67C up the ramp 51C. The taper angles of the wedge and ramp are equal so that the flat surface 71C of the tool may always be parallel to the flat undersurface 73 of the block, thereby to urge the block directly out of its socket without canting. This may be necessary in certain sizes and configurations of reamer parts. In other cases, the block removal apparatus and construction of FIG. 1 may suffice. It may be noted that since the blocks are interconnected by the roller shafts, when a block moves out of its socket it must pivot in the relatively large radius arc centered in the other block connected to the same shaft; this prevents excess canting. First one block will be driven out a little way, then the other, alternating until both blocks are free.

In all of the foregoing embodiments and modifications, preferably the steps, e.g. 47C, in the body sockets and, e.g. 57C, on the blocks are located so that the steps are close but slightly spaced apart. This insures that the blocks sit on the socket bottoms while providing maximum engagement between cylindrical portions of the blocks and sockets. If the engaged large diameter parts of the cylindrical surfaces of the blocks and sockets are equal in length to the engaged small diameter cylindrical parts, the blocks will release most quickly, i.e. as soon as the bottoms of the blocks move past the socket steps. In other words, referring to FIG. 9C, the distance "X" from socket bottom to socket step should equal the distance "Y" from block step to socket lip (at the greatest depth of the socket) in order to effect quickest release. In the case of the FIG. 9C body modification, the height "Z" of ramps 51C above the bottom of each groove 47C should equal the distance required to effect full release of each block, i.e., the greater of distances "X" and "Y" if they are different or equal to distances "X" and "Y" if they are equal.

III. Third Embodiment

Referring now to FIGS. 10–13, there is shown an embodiment of the invention suitable for use with air lubricated bearings, with the air drilling fluid passing through the roller shafts, as in the aforementioned Garrett U.S. Pat. No. Re. 27,781. The construction will be the same as disclosed in FIG. 10 of that patent except for the mounting of the roller shafts and the resulting elimination of the need for a two piece body. For correlation with the previously described embodiments, parts similar to those of FIG. 1 will be given like reference numbers plus 300.

The body 323 of the reamer includes an upper end portion 326 and a lower end portion 328. Similar to the other embodiments of the invention, these end portions will be provided at their upper and lower termini with threaded means for making rotary shouldered connections with adjacent drill stem members, such means being shown in FIGS. 2 and 3. However the mid portion of the reamer body connecting the end portions 324, 326, thereof is not a single member as in the previously described embodiments but consists instead of a plurality of bars 328. As described in the aforementioned Garrett reissue patent, this provides maximum room for the rollers. In order to provide for flow of drilling fluid through the tool, the shafts 377 are tubular, forming flow passages 378 therethrough. Flow passages 378 connect through holes 375 in blocks 353 in which the shafts are mounted with lateral flow passages 380 in body end portions 326, 328. The lateral flow passages extend from sockets 339 in which blocks 353 are mounted to axial flow passages 324 in end portions 326, 328.

To lubricate, clean and cool the bearing surfaces between the rollers 333 and the shafts 377 on which they are rotatably mounted, air is bled off from the interior of shafts 377 through one or more radial ports 384. Each shaft 377 is provided on one side with a flat area 386 extending longitudinally from port 384 to distribute the air along the length of the shaft between the surfaces of the radial bearing provided by the inner periphey 383 of the roller and the outer periphery 385 of the shaft. Ultimately, the air leaks out between the flat ends 382 of the roller and the flat sides 354 of the blocks 353. This not only cleans, cools and lubricates radial bearing surfaces 383, 385 but also surfaces 354, 382, which take the axial thrust as in the FIG. 1 embodiment.

Figure 10:
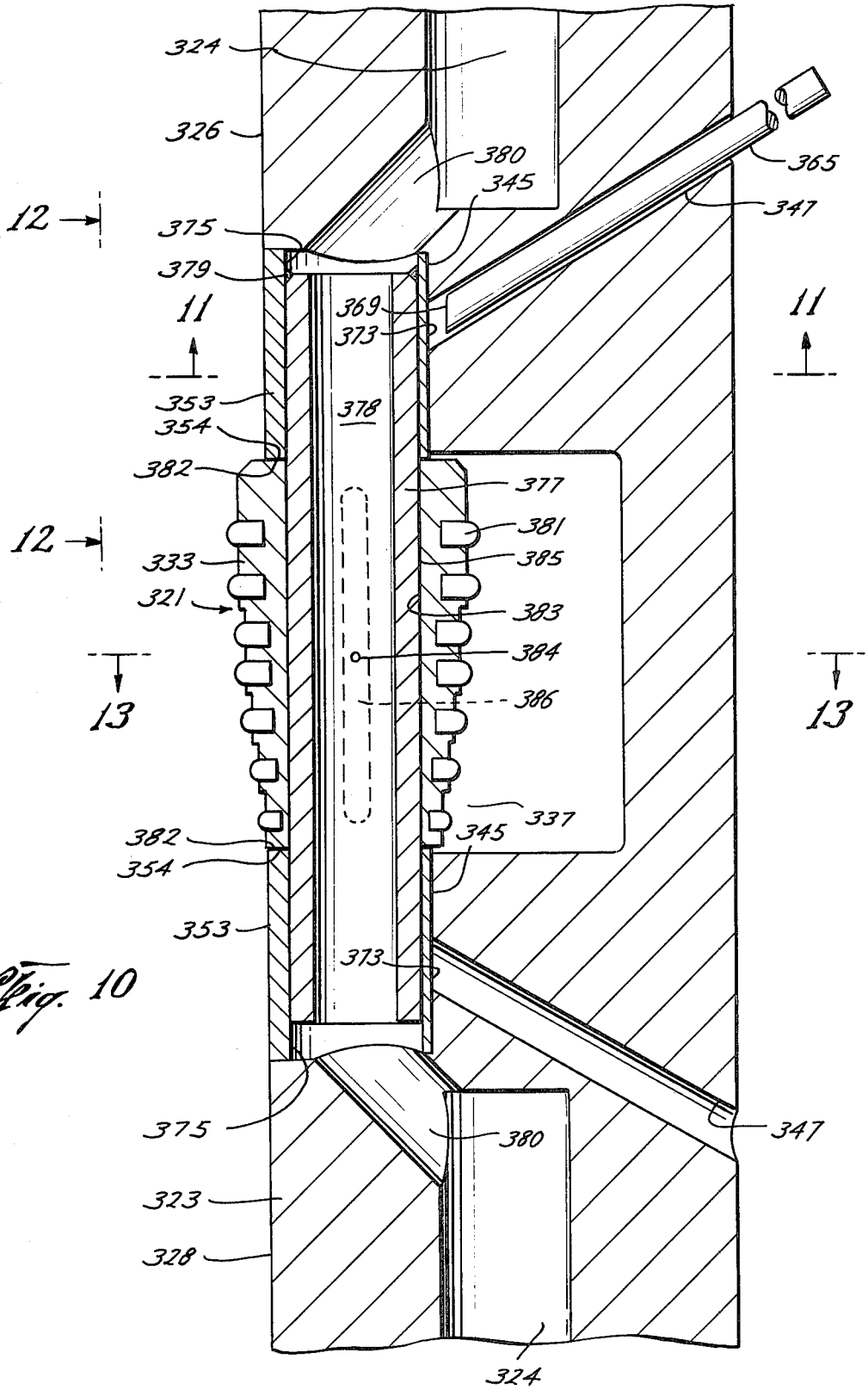
FIG. 10 is a fragmentary half section through a reamer according to yet another embodiment of the invention employing air lubrication.
Figure 11:
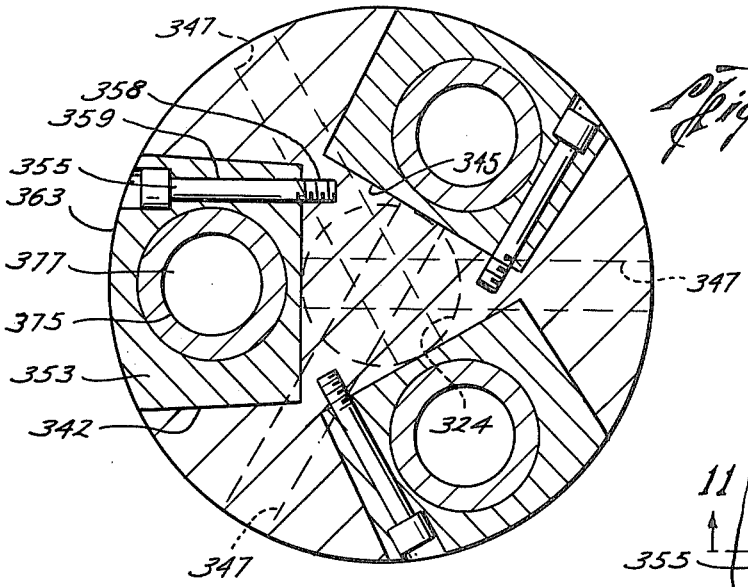
FIG. 11 is a section taken at plane 11—11 of FIG. 10.
Figure 12:
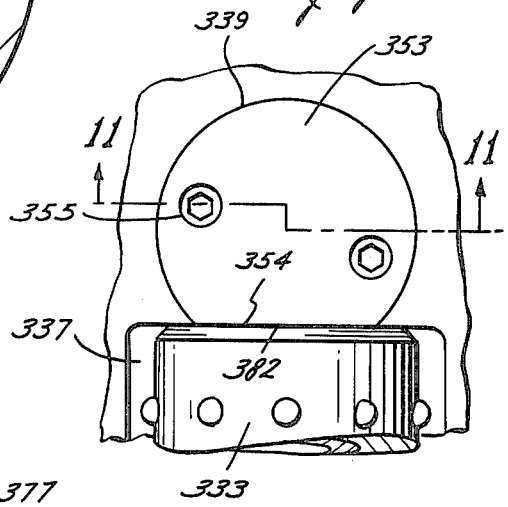
FIG. 12 is a fragmentary elevation viewed at 12—12 indicated on FIG. 10.

In the FIG. 10 embodiment, the shafts 377 are mounted in cylindrical holes 375 in blocks 354 as in the FIG. 1 embodiment. One end of each shaft may be welded to a block at 379 and/or make an interference fit therewith. The other end of each shaft makes a close fit with the block but is free to turn and to move axially. Also, the blocks 354 are mounted in sockets 339, see FIG. 12, in the upper and lower end portions 324, 326 of the body. However, the inner peripheries of sockets 339 are not stepped but instead are conically tapered with a seizing taper. A seizing taper is one whose taper angle is greater than the angle whose tangent is the coefficient of friction. Something of the order of one inch change in diameter per foot for steel blocks in steel sockets would be suitable. The sides of the blocks 353, except for the flat portions 354, adjacent the rollers, are correlatively conically tapered. The sides of the blocks must make a tight sealing fit with the body end portions where the fluid passages 380 enter the sockets 339. For this reason instead of providing access to the flat back side or bottom of each block through an opening or passage such as 47, 49 in the FIG. 1 embodiment, which extends along the surface of the reamer body, tool passages 347 are provided extending in diametral planes clear through the body end portions. Tool passages 347 angle away from the flat bottoms 345 of sockets 339, upwardly and downwardly toward the terminii of the body end portions 326, 328. This is to avoid intersection with adjacent sockets 339 (FIG. 12), as best seen in FIG. 11.

Blocks 353 are locked in place by cap screws 355 extending through plain holes 359 in the blocks into threaded holes 357 in the body end portions. Two cap screws are employed for each block, with the plane defined by axes of each pair of cap screws lying at an angle to the perpendicular to the reamer axis. In other words, the screws of each pair lie in different planes perpendicular to the reamer axis so their inner ends do not interfere with those of adjacent pairs of cap screws.

When it is desired to replace a roller and shaft the cap screws holding the body blocks supporting the shaft on which the roller is mounted are removed. Then a steel bar 365 or other equivalent tool is inserted through one of the tool passages 347 into contact with the bottom of one of the blocks 353. A blow on the end of the bar 365 serves to knock the block loose. Due to the taper of the sides of the block, any slight axial movement causes it to be entirely free. In this regard the construction is somewhat similar to the blocks of the FIGS. 1 and 9 constructions in that the outermost part of the block is of greater diameter than the innermost part, though in FIGS. 1 and 9 stepped cylindrical walls are employed while a conical taper is used in FIG. 11.

Preferably bar 365 is of circular cross section, to fit easily into the cylindrical tool passage 347, and the end 369 of the bar is cut off flat at an angle to be parallel with the flat bottom 373 of the block, to avoid denting it. The blocks may be driven out gradually, first moving one a little bit and then the other until both are all the way out.

After the blocks supporting the ends of the shaft are knocked free, the one block which is not welded to the shaft may be pressed off, the roller replaced, and the block pressed back on again, as with the previously described embodiments, or the shaft and blocks may be replaced along with the roller. When the unit consisting of two blocks, shaft, and roller is reinstalled in the body, the pressed on block can rotate about the shaft as may be required for both tapered blocks to fit simultaneously. A tight fit is then achieved preventing air leakage between the blocks and body.

It will be seen that by employment of the invention, the reamer rollers are mounted in such a way as to provide firm support and good lubrication, while at the same time the rollers are easily replaced.

Figure 13:
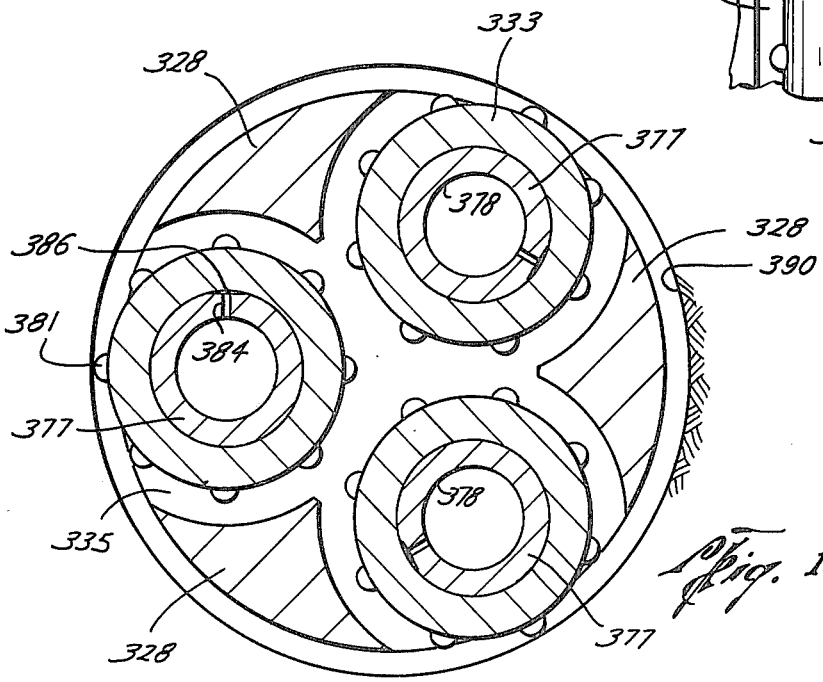
FIG. 13 is a section taken at plane 13—13 of FIG. 10.

Referring to FIG. 13, it is to be noted that when the reamer is in use, the tungsten carbide inserted teeth 381 of each roller are in contact with the wall of earth bore 390. Similar geometry applies to the rollers of all the embodiments of the invention. The reamers may therefore be called wall contacting tools. This term is generic both to reamers, as disclosed, which are intended to ream out the earth bore if the drill bit becomes worn undergage, and hence have full bore maximum diameters, and to roller stabilizers, which have maximum diameters slightly less than full bore, being intended only to prevent excessive canting and lateral shifting of the drill string in the bore. In the case of a reamer the carbide teeth function as earth formation reducing means, similar to the carbide teeth on a drill bit. In a stabilizer, the carbide inserts may be considered to be primarily wear prevention means.

However, a stabilizer may do some reaming and a reamer certainly functions also as a stabilizer. The subject invention is applicable to both types of tool. It is also applicable to tools having any type of roller structure from smooth to milled teeth to carbide inserts. Likewise the rollers may be set at any angle as previously discussed in describing the prior art.

While preferred embodiments of the invention have been shown and described, modifications thereof can be made by one skilled in the art without departing from the spirit of the invention.

I claim:

1. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets and making a tight fit therewith, each block having a front facing radially outwardly of said end portion and a back facing radially inwardly, a plurality of shafts each supported at each end by one of the blocks in different ones of said end portions, a roller rotatably mounted on each shaft, and tool cooperation means carried by the apparatus for cooperation with a tool for forcing out the blocks when it is desired to replace the rollers, said tool cooperation means comprising tool passage means each providing an opening extending from the surface of one of said end portions of the body which is adjacent the socket to behind the bottom of the socket, each said opening including a portion of constant depth extending away from the side of the block farthest from the rollers and an inclined portion sloping upwardly from said portion of constant depth to said surface.

2. Apparatus according to claim 1, said tool having a knockout bar in said opening, said bar including a wedge shaped head resting in said constant depth portion of one of said openings and engaging one of said blocks and a handle extending through said inclined portion of the opening beyond the outer periphery of the body of the tool.

3. Apparatus according to claim 1 including means to admit fluid to the outer periphery of each shaft for lubricating same with fluid at the pressure of the drilling fluid used with the tool.

4. Apparatus according to claim 1, each said opening including a ramp in said constant depth portion thereof extending under the bottom of the adjacent socket.

5. Apparatus according to claim 4, said apparatus having a knockout bar in said opening, said bar including a wedge shaped tip engaging said ramp, a head resting in said constant depth portion of one of said openings, and a handle lying in said inclined portion of the last said opening.

6. Apparatus according to claim 5, said handle having its length disposed at an angle to said head equal to the inclination of said inclined portion of the last said opening, said wedge having a taper equal to the slope of said ramp.

7. Apparatus according to claim 1, one end of each shaft being secured to the block in which it is supported by means preventing the shaft from turning about its axis relative to the block to which it is thus secured, the other end of each shaft being capable of moving axially and turning about its axis relative to the block in which it is mounted.

8. Tool according to claim 7, each block having a hole extending therethrough within which is disposed one of said shaft ends for support of the shaft, the means securing one end of each shaft to the block to which it is secured comprising weld means, the other end of each shaft making a transition fit with the hole in the block in which it is supported.

9. Apparatus according to claim 8, there being an annular compartment formed between the neck, skirt, block, and shaft of the respective roller and replaceable support means therefor, said rotating sealing means including washer metal washer forming a rotary seal with the neck and an elastomeric ring urging said washer against said neck and forming a seal between said washer and the respective shaft.

10. Apparatus according to claim 7, the means securing one end of each shaft to the block in which it is secured comprising registering openings in the block and shaft and a pin in said openings.

11. Apparatus according to claim 10, said pin making an interference fit with at least one of said openings.

12. Apparatus according to claim 10, said openings in the block including an outer opening and an inner opening nearer the axis of the tool body than said outer opening, said inner opening having an outwardly facing shoulder, said pin being a roll pin seating on said shoulder.

13. Apparatus according to claim 12, said roll pin making an interference fit with both of said openings in said block and with said opening in said shaft.

14. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets and making a tight fit therewith, each block having a front facing radially outwardly of said end portion and a back facing radially inwardly, a plurality of shafts each supported at each end by one of the blocks in different ones of said end portions, a roller rotatably mounted on each shaft, and tool cooperation means carried by the apparatus, for cooperation with a tool for forcing out the blocks when it is desired to replace the rollers, said tool cooperation means comprising tool passage means each providding an opening extending from the surface of one of said end portions of the body which is adjacent the socket to behind the bottom of the socket, each said opening including a ramp extending under the bottom of the socket.

15. Apparatus according to claim 14, said sockets and blocks being generally cylindrical and stepped with engaged side portions making an interference fit, each ramp having a height at least as high as the distance from the bottom of the socket of the step next to the bottom and said distance being at least equal to the distance from the step or the block to the mouth of the socket.

16. Apparatus according to claim 15, said roller groove being disposed near one end of the shaft, said reservoir means in each shaft being disposed in the portion of the shaft farthest from said one end thereof, each said shaft having a passage extending from the other end thereof to said reservoir, said passage being provided with closure means, and pressure equalizing means at the end of each said reservoir nearest said one end of the shaft at which the reservoir is disposed.

17. A knockout tool for releasing the rollers of well apparatus according to claim 14, said bar including a straight handle portion, a head portion disposed at an obtuse angle to said handle, and a tapered tip having a bevel surface disposed at an obtuse angle to said head and a greater angle with said handle.

18. A wall contacting apparatus useful in earth boring by the rotary method, comprising:

a body having first and second aligned end portions,
thread means at a terminus of each end portion for making a rotary shouldered connection with an adjacent drill string member,
each end portion being provided with a plurality of sockets in its outer periphery,
a plurality of blocks disposed one in each socket and having side walls generally correlative to those of said sockets and making a tight fit therewith, each block having a front facing radially outwardly of said end portion and a back facing radially inwardly,
a plurality of shafts each supported at each end by one of the blocks in different ones of said end portions,
a roller rotatably mounted on each shaft, and
tool cooperation means carried by the apparatus for cooperation with a tool for facing out the blocks when it is desired to replace the rollers,
said tool cooperation means comprising tool passage means each providing an opening extending from the surface of one of said end portions of the body which is adjacent the socket to behind the bottom of the socket,
said tool passage means comprising openings in said end portions extending from the bottoms of sockets through the end portions to the sides thereof opposite from said sockets.

19. Apparatus according to claim 18,
said openings of the tool passage means angling from the bottom of each socket toward the adjacent terminus of the end portion without passing through any of the other sockets.

20. Apparatus according to claim 19,
said apparatus having a knockout bar in one of said openings extending from the bottom of the socket through the surface of the body.

21. A wall contacting apparatus useful in earth boring by the rotary method, comprising:
a body having first and second aligned end portions,
thread means at a terminus of each end portion for making a rotary shouldered connection with an adjacent drill string member,
each end portion being provided with a plurality of sockets in its outer periphery,
a plurality of blocks disposed one in each socket and having side walls generally correlative to those of said sockets and making a tight fit therewith, each block having a front facing radially outwardly of said end portion and a back facing radially inwardly,
a plurality of shafts each supported at each end by one of the blocks in different ones of said end portions,
a roller rotatably mounted on each shaft, and
tool cooperation means carried by the apparatus for cooperation with a tool for forcing out the blocks when it is desired to replace the rollers,
said tool cooperation means comprising tool passage means each providing an opening extending from the surface of one of said end portions of the body which is adjacent the socket to behind the bottom of the socket,
said tool passage means comprising openings in said end portions extending from the bottoms of the sockets through the end portions to the sides thereof opposite from said sockets,
said openings of the tool passage means angling from the bottom of each socket toward the adjacent terminus of the end portion without passing through any of the other sockets,
said apparatus having a knockout bar in one of said openings extending from the bottom of the socket through the surface of the body,
said knockout bar having a flat end lying at an angle to its length correlative to the slope of said opening.

22. A wall contacting apparatus useful in earth boring by the rotary method, comprising:
a body having first and second aligned end portions,
thread means at a terminus of each end portion for making a rotary shouldered connection with an adjacent drill string member,
each end portion being provided with a plurality of sockets in its outer periphery,
a plurality of blocks disposed one in each socket and having side walls generally correlative to those of said sockets and making a tight fit therewith, each block having a front facing radially outwardly of said end portion and a back facing radially inwardly,
a plurality of shafts each supported at each end by one of the blocks in different ones of said end portions,
a roller rotatably mounted on each shaft, and
tool cooperation means carried by the apparatus, for cooperation with a tool for forcing out the blocks when it is desired to replace the rollers,
each block and its socket including side portions which in cross section are arcs of circles,
said blocks each having inner portions where a radius of said circles is smaller and outer portions where a radius of said circles is larger.

23. Apparatus according to claim 22,
each block being held in its socket by radial compression of the sides of the block and socket creating friction therebetween,
each block being locked in position by screw means extending through the block into the body.

24. Apparatus according to claim 23,
said side walls including cylindrical portions,
said fit being a drive fit.

25. Apparatus according to claim 23,
said side walls including conical portions,
the conical side wall portions having a seizing taper.

26. Apparatus according to claim 22,
said side portions of said blocks and sockets being generally cylindrical and stepped.

27. Apparatus according to claim 26, said blocks engaging the bottoms of the sockets, the steps on the blocks being spaced from the steps in the sockets, said blocks being secured to the reamer body by means of screws.

28. Tool according to claim 26,
said side portions of said blocks making interference fits with said sockets.

29. Apparatus according to claim 28, the axial extent of the interference fit areas on opposite sides of the steps being equal.

30. A wall contacting apparatus useful in earth boring by the rotary method, comprising:
a body having first and second aligned end portions,
thread means at a terminus of each end portion for making a rotary shouldered connection with an adjacent drill string member,
each end portion being provided with a plurality of sockets in its outer periphery,
a plurality of blocks disposed one in each socket and having side walls generally correlative to those of said sockets and making a tight fit therewith, each block having a front facing radially outwardly of said end portion and a back facing radially inwardly, a plurality of shafts each supported at each end by one of the blocks in different ones of said end portions, a roller rotatably mounted on each shaft, and tool cooperation means carried by the apparatus for cooperation with a tool for forcing out the blocks when it is desired to replace the rollers, said tool cooperation means comprising tool passage means each providing an opening extending from the surface of one of said end portions of the body which is adjacent the socket to behind the bottom of the socket, each rooler having a hole extending axially thereof through which extends the shaft on which the roller is rotatably mounted, the inner periphery of said roller at said hole and the/ outer periphery of said shaft providing radial bearing means for the roller, each shaft and the blocks at each end thereof providing replaceable support means for the roller mounted on the shaft, and thrust bearing means for each roller, to take the axial thrust thereon, comprising shoulder means on each roller and cooperative shoulder means on the replaceable support means for the roller, said rollers and support means being readily replaceable by placing a suitable tool behind each block through said tool passage means and forcing out the support means.

31. Apparatus according to claim 30, each block including at the side thereof nearest the roller that is on the shaft mounted in the block, a roller adjacent portion, each roller including at each end a block adjacent portion opposite from the adjacent roller adjacent portion of the block, said block adjacent portions of each roller and the roller adjacent portions of the blocks that support the shaft on which the roller is mounted, presenting opposed faces allowing free rotation of the roller on the shaft.

32. Apparatus according to claim 31, one of said end portions of the apparatus being an upper portion and the other being a lower portion, said apparatus including barrier means between the upper end of each shaft and upper end of each roller to protect the radial bearing surfaces from the entrance of particulate matter entrained in the drilling fluid ambient at the upper ends of said surfaces.

33. Apparatus according to claim 32, each said barrier means including an annular tongue upstanding from the end of the roller, and annular skirt around said tongue depending from the block above the roller, there being an annular compartment formed between the tongue, skirt and shaft, and sealing means in said compartment.

34. Apparatus according to claim 33, each roller including a plurality of tungsten carbide inserts in its outer periphery, some of said inserts extending through registering openings in said parts of each roller and pinning the parts together.

35. Apparatus according to claim 32, said shoulder means on each replaceable support means comprising a plurality of balls disposed in an annular channel around the shaft, said shoulder means on each roller comprising an annular groove in the shafts inner periphery into which said balls extend, each said roller comprising a roller fabricated with a filler opening through which said balls can be introduced into the toroidal space formed by the shaft channel and cooperating roller groove when in register, and means closing said filler opening.

36. Apparatus according to claim 33, the interface between said opposed faces of said end portion of each roller at the lower end thereof and the mounting block for the shaft on which the roller is mounted forming fluid passage means for admitting ambient drilling fluid to said radial bearing means at the lower end thereof to lubricate said radial bearing means.

37. Apparatus according to claim 36, said sealing means in each said compartment of said barrier means including a metal washer engaging the upper end of the tongue to form a metal-to-metal rotary seal with the roller and an elastomeric ring above the washer pressing the washer into contact with the tongue and sealing between the washer and said replaceable support means.

38. Apparatus according to claim 33, said shoulder means on each replaceable support means comprising a radial flange on the shaft located in a position between the ends of the roller, said shoulder means on each roller comprising an annular groove within which groove is disposed said flange, thereby to take axial thrust on the roller and tranfer it to the shaft.

39. Apparatus according to claim 38, each roller being fabricated from two parts each of which parts provides one side of said groove in the roller, the two parts of each roller being secured together with said flange captured therebetween.

40. Apparatus according to claim 39, said parts of each roller being telescopically fitted together with an interference fit.

41. Apparatus according to claim 39 one part of each roller having an axially extending socket and the other part of each roller fitting therein telescopically as aforesaid, said parts being welded together at the mouth of each socket, said other part of each roller carrying said tongue.

42. Apparatus according to claim 31, including seal means at one end of each roller comprising rotating seal means between the roller and the adjacent block, the block being sealed to the shaft.

43. Apparatus according to claim 42, the said adjacent block at one end of each shaft being sealed to the shaft by being welded thereto at the end of the shaft, each shaft making a transition fit with the hole in the block at the other end of the shaft.

44. Apparatus according to claim 43, one end of each roller having a neck and the adjacent block having a skirt into which said neck extends, said rotating seal between block and roller being between the inside of the skirt and outside of said neck, each roller being of decreasing diameter progressing in a direction away from the end nearest the block supporting the roller, which block has said skirt.

45. Apparatus according to claim 31, said shoulder means on each replaceable support means comprising radially protuberant means extending from the shaft, located in a position in between the ends of the rollers, and said shoulder means on each roller comprising an annular groove in the roller's inner periphery within which groove is captured, the radially protuberant means thereby to take axial thrust on the roller in both directions and transfer it to the shaft, means to seal between each roller and shaft on opposite sides of said radially protuberant means, and lubricant reservoir means in each shaft communicating with the exterior of the shaft between said seals.

46. Apparatus according to claim 45, said radially protuberant means composing a plurality of balls disposed in an annular channel around the shaft, each said roller comprising a roller fabricated with a filler opening through which said balls can be introduced into the toroidal space formed by the shaft channel and cooperating roller groove when in register, and means closing said filler opening.

47. Apparatus according to claim 45, said radially protuberant means comprising a flange integral with the shaft, each roller being fabricated from two parts which parts provide opposite sides of said annular groove, the two parts being secured together with said flange captured therebetween.

48. Apparatus according to claim 47, one part of each roller having a socket extending axially thereof and the other part of each roller fitting therein telescopically with an interference fit.

49. Apparatus according to claim 48, each roller including a plurality of tungsten carbide inserts in its outer periphery, some of said inserts extending through registering openings in said parts of each roller and pinning the parts together.

50. Apparatus according to claim 47, said parts being welded together at the mouth of each socket, said part with the socket including the lower end of each roller, and barrier means between the other part of each roller and the shaft to direct ambient drilling fluid away from the seal means between roller and shaft at that end of the roller.

51. Apparatus according to claim 50, said barrier means including a tongue on said other part of each roller, and a skirt thereabout depending from the adjacent block, said sealing means at that end of the roller being disposed in the annular compartment formed between the tongue, skirt, block, and shaft of the respective roller and replaceable support means therefor.

52. Apparatus according to claim 46, the said sealing means including a metal washer forming a rotary seal with the tongue and an elastomeric ring urging said washer against said tongue and forming a seal between said washer and the respective shaft.

53. A wall contacting apparatus useful earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets and making a tight fit therewith, each block having a front facing radially outwardly of said end portion and a back facing radially inwardly, a plurality of shafts each supported at each end by one of the blocks in different ones of said end portions, a roller rotatably mounted on each shaft, and tool cooperation means carried by the apparatus, for cooperation with a tool for forcing out the blocks when it is desired to replace the rollers, said end portions of the body being tubular and of generally circular cross section and of generally cylindrical shape adjacent said sockets therein, said end portions being connected by an intermediate portion of the body which is also tubular and of generally circular cross section and having pockets in its sides to receive said rollers, said fronts of said blocks protruding from said sockets and being of cylindrical shape but bevelled at their lateral sides and their sides farthest from said pockets to form gradual transitions to said cylindrical shape of said end portions of the body.

54. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets, a plurality of shafts each supported at each end by one of the blocks in different ones of said end portions, and a roller rotatably mounted on each shaft, each block and its socket including side portions which in cross section are arcs of circles, said blocks each having inner portions where the radii of said circles is smaller and outer portions where the radii of said circles is larger.

55. A wall contacting apparatus according to claim 54, further comprising:

tool cooperation means carried by the apparatus for cooperation with a tool for forcing out the blocks when it is desired to replace the rollers.

56. Apparatus according to claim 55, said tool cooperation means comprising tool passage means each providing an opening extending from the surface of one of said end portions of the body which is adjacent the socket to behind the bottom of the socket.

57. Apparatus according to claim 54, said blocks engaging the bottoms of the sockets, the steps on the blocks being spaced from the steps in the sockets, said blocks being secured to the reamer body by means of screws.

58. Apparatus according to claim 54, each block being held in its socket by radial compression of the sides of the block and socket creating friction therebetween, each block being locked in position by screw means extending through the block into the body.

59. Apparatus according to claim 58, said side walls including conical portions, the conical side wall portions having a seizing taper.

60. Apparatus according to claim 58, said side walls including cylindrical portions, said fit being a drive fit.

61. Apparatus according to claim 60, said side portions of said blocks and sockets being generally cylindrical and stepped.

62. Tool according to claim 61, said side portions of said blocks making interference fits with said socket.

63. Apparatus according to claim 62, the axial extent of the interference fit areas on opposite sides of the steps being equal.

64. A wall contacting apparatus according to claim 54 one end of each shaft being secured to the block in which it is supported by means preventing the shaft from turning about its axis relative to the block to which it is thus secured, the other end of each shaft being capable of moving axially and turning about its axis relative to the block in which it is mounted.

65. Tool according to claim 64, each block having a hole extending therethrough within which is disposed one of said shaft ends for support of the shaft, the means securing one end of each shaft to the block to which it is secured comprising weld means, the other end of each shaft making a transition fit with the hole in the block in which it is supported.

66. Apparatus according to claim 64, the means securing one end of each shaft to the block in which it is secured comprising registering openings in the block and shaft, and a pin in said openings.

67. Apparatus according to claim 66, said pin making an interference fit with at least one of said openings.

68. Apparatus according to claim 66, said openings in the block including an outer opening and an inner opening nearer the axis of the tool body than said outer opening, said inner opening having an outwardly facing shoulder, said pin being a roll pin seating on said shoulder.

69. Apparatus according to claim 64, said roll pin making an interference fit with both of said openings in said block and with said opening in said shaft.

70. A wall contacting apparatus according to claim 54, each shaft having a flow passage extending axially thereof, said end portions of the body having flow passages extending axially from said termini and thence laterally to said sockets, each block including a hole receiving one end of one of the shafts, said holes extending clear through said blocks placing the ends of said flow passages in the shafts in communication with said flow passages in said end portios where they connect with said sockets.

71. Apparatus according to claim 70, said sockets and blocks including correlatively conically tapered side wall portions, said body and blocks being made of steel, the taper angle of said wall portions being less than the angle whose tangent is the coefficient of friction between said wall portions of said sockets and blocks.

72. Apparatus according to claim 70, said side walls of said blocks and sockets being conical giving them a taper, said taper being a seizing taper.

73. Apparatus according to claim 70, said side walls being conical.

74. Apparatus according to claim 70, said side walls of said block being tapered, the taper of said side walls being a seizing taper.

75. Wall contacting apparatus according to claim 54 further comprising:

flow passage means extending through said apparatus from the terminus of one end portion to the terminus of the other end portion including a passage extending axially through each shaft and the blocks in which it is mounted, said body including load bars interconnecting said end portions to transmit torsional and axial forces and bending moments therebetween to reduce the strain of such forces on said shafts and blocks, said load bars being spaced from the axis of said tool and dispoed between said shafts, said body being a one piece member free of weld joints.

76. Apparatus according to claim 75, said body having sockets to receive said blocks, each block and its socket having side walls that are conically tapered with a seizing taper.

77. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets, a plurality of shafts each supported at each end by one of the blocks in different ones of said end portions, and a roller rotatably mounted on each shaft, each roller having a hole extending axially thereof through which extends the shaft on which the roller is rotatably mounted, the inner periphery of said roller at said hole and the other periphery of said shaft providing radial bearing means for the roller, each shaft and the blocks at each end thereof providing replaceable support means for the roller mounted on the shaft, thrust bearing means for each roller to take the axial thrust thereon comprising shoulder means on each roller and cooperative shoulder means on the replaceable support means for the roller, one of said end portions of the apparatus being an upper portion and the other being a lower portion, and barrier means between the upper end of each shaft and upper end of each roller to protect the radial bearing surfaces from the entrance of particulate matter entrained in the ambient drilling fluid at the upper ends of said surfaces.

78. Apparatus according to claim 77, said shoulder means on each replaceable support means comprising a plurality of balls disposed in an annular channel around the shaft, said shoulder means on each roller comprising an annular groove in the shaft's inner periphery into which said balls extend, each said roller comprising a roller fabricated with a filler opening through which said balls can be introduced into the toroidal space formed by the shaft channel and cooperating roller groove when in register, and means closing said filler opening.

79. Apparatus according to claim 77, each said barrier means including an annular tongue upstanding from the end of the roller, and an annular skirt around said tongue depending from the block above the roller, there being an annular compartment formed between the tongue, skirt and shaft, and sealing means in said compartment.

80. Apparatus according to claim 79, the interface between the opposed faces of the end portion of each roller at the lower end thereof and the mounting block for the shaft on which the roller is mounted forming fluid passage means for admitting ambient drilling fluid to said radial bearing means at the lower end thereof to lubricate said radial bearing means.

81. Apparatus according to claim 80, said sealing means in each said compartment of said barrier means including a metal washer engaging the upper end of the tongue to form a metal-to-metal rotary seal with the roller and an elastomeric ring above the washer pressing the washer into contact with the tongue and sealing between the washer and said replaceable support means.

82. Apparatus according to claim 80, said shoulder means on each replaceable support means comprising a radial flange on the shaft located in a position between the ends of the roller, said shoulder means on each roller comprising an annular groove within which groove is disposed said flange, thereby to take axial thrust on the roller and transfer it to the shaft, the thrust bearings being lubricated by ambient drilling fluid admitted to said radial bearings at said interfaces at the lower ends of the rollers.

83. Apparatus according to claim 82, each roller being fabricated from two parts of which parts provides one side of said groove in the roller, the two parts of each roller being secured together with said flange captured therebetween.

84. Apparatus according to claim 83, each roller including a plurality of tungsten carbine inserts in its outer periphery, some of said inserts extending through registering openings in said parts of each roller and pinning the parts together.

85. Apparatus according to claim 83, said parts of each roller being telescopically fitted together with an interference fit.

86. Apparatus according to claim 85, one part of each roller having an axially extending socket and the other part of each roller fitting therein telescopically as aforesaid, said parts being welded together at the mouth of each socket, said other part of each roller carrying said tongue.

87. Apparatus according to claim 77, including seal means at one end of each roller comprising rotating seal means between the roller and the adjacent block, the block being sealed to the shaft.

88. Apparatus according to claim 87, the said adjacent block at one end of each shaft being sealed to the shaft by being welded thereto at the end of the shaft.

each shaft making a transition fit with the hole in the block at the other end of the shaft.

89. Apparatus according to claim 87, one end of each roller having a neck and the adjacent block having a skirt into which said neck extends, said rotating seal between block and roller being between the inside of the skirt and outside of said neck, each roller being of decreasing diameter progressing in a direction away from the end nearest the block supporting the roller which block has said skirt.

90. Apparatus according to claim 89, there being an annular compartment formed between the neck, skirt, block, and shaft of the respective roller and replaceable support means therefor, said rotating sealing means including metal washer forming a rotary seal with the neck and an elastomeric ring urging said washer against said neck and forming a seal between said washer and the respective shaft.

91. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets, a plurality of shafts each supported at each end by one of the blocks in different ones of said end position, and a roller rotatably mounted on each shaft, each roller having a hole extending axially thereof through which extends the shaft on which the roller is rotatably mounted, the inner periphery of said roller at said hole and the outer periphery of said shaft providing radial bearing means for the roller, each shaft and the blocks at each end thereof providing replaceable support means for the roller mounted on the shaft, thrust bearing means for each roller to take the axial thrust thereon comprising shoulder means on each roller and cooperative shoulder means on the replaceable support means for the roller, said shoulder means on each replaceable support means comprising radially protuberant means extending from the shaft located in a position in between the ends of the rollers, and said shoulder means on each roller comprising an annular groove in the roller's inner periphery within which groove is captured the radially protuberant means, thereby to take axial thrust on the roller in both directions and transfer it to the shaft, means to seal between each roller and shaft on opposite sides of said radially protuberant means, and lubricant reservoir means in each shaft communicating with the exterior of the shaft beween said seals.

92. Apparatus according to claim 91, said radially protuberant means comprising a flange integral with the shaft, each roller being fabricated from two parts which parts provide opposite sides of said annular groove, the two parts being secured together with said flange captured therebetween.

93. Apparatus according to claim 92, one part of each roller having a socket extending axially thereof and the other part of each roller fitting therein telescopically with an interference fit.

94. Apparatus according to claim 93, each roller including a plurality of tungsten carbide inserts in its outer periphery, some of said inserts extending through registering openings in said parts of each roller and pinning the parts together.

95. Apparatus according to claim 92, said parts being welded together at the mouth of each socket, said part with the socket including the lower end of each roller, and barrier means between the other part of each roller and the shaft to direct ambient drilling fluid away from the seal means between roller and shaft at that end of the roller.

96. Apparatus according to claim 95, said barrier means including a tongue on said other part of each roller, and a skirt thereabout depending from the adjacent block, said sealing means at that end of the roller being disposed in the annular compartment formed between the tongue, skirt, block, and shaft of the respective roller and replaceable support means therefor.

97. Apparatus according to claim 96, the said sealing means including a metal washer forming a rotary seal with the tongue and an elastomeric ring urging said washer against said tongue and forming a seal between said washer and the respective shaft.

98. Apparatus according to claim 96, including passage means for said reservoir to said compartment to equalize the pressure around said sealing means.

99. Apparatus according to claim 91, said radially protuberant means comprising a plurality of balls disposed in an annular channel around the shaft, each said roller comprising a roller fabricated with a filler opening through which said balls can be introduced into the toroidal space formed by the shaft channel and cooperating roller groove when in register, and means closing said filler opening.

100. Apparatus according to claim 99, said roller groove being disposed near one end of the shaft, said reservoir means in each shaft being disposed in the portion of the shaft farthest from said one end thereof, each said shaft having a passage extending from the other end thereof to said reservoir, said passage being provided with closure means, and pressure equalizing means at the end of each said reservoir nearest said one end of the shaft at which the reservoir is disposed.

101. A wall contacting apparatus useful in earth boring by the rotary method, comprising:

a body having first and second aligned end portions, thread means at a terminus of each end portion for making a rotary shouldered connection with an adjacent drill string member, each end portion being provided with a plurality of sockets in its outer periphery, a plurality of blocks disposed one in each socket and having side walls generally correlative to those of said sockets, a plurality of shafts each supported at each end by one of the blocks in different ones of said end portions, and a roller rotatably mounted on each shaft, said end portions of the body being tubular and of generally circular cross section and of generally cylindrical shape adjacent said sockets therein, said end portions being connected by an intermediate portion of the body which is also tubular and of generally circular cross section and having pockets in its sides to receive said rollers, said fronts of said blocks protruding from said sockets and being of cylindrical shape but bevelled at their lateral sides and their sides farthest from said sockets to form gradual transitions to said cylindrical shape of said end portions of the body.

102. A wall contacting apparatus useful in earth boring by the rotary method comprising:

a body, said body having a plurality of rollers rotatably mounted thereabout, each roller having a hole extending axially therethrough providing a bearing surface and being mounted for rotation on a shaft providing a bearing surface extending through the hole, the shaft being secured to said body, and thrust bearing means to transfer axial loads between each roller and shaft comprising a flange on each shaft and a pair of internal bearing surfaces carried by each roller, said flange being captured between said bearing surfaces, and opening means to admit fluid to the outer periphery of each shaft for lubricating same and said flange and bearing surfaces with fluid at the pressure of the drilling fluid used with the tool.

103. Apparatus according to claim 102, each shaft including a lubricant reservoir, said opening means communicating said reservoir to said outer periphery of each shaft, said flange, and said bearing surfaces, and means isolating said reservoir, opening means, and bearing surfaces from the exterior of said apparatus.

104. Apparatus according to claim 103, said isolating means comprising rotating seal means between each end of the roller and the respective shaft.

* * * * *

UNITED STATES PATENT AND TRADEMARK OFFICE

CERTIFICATE OF CORRECTION

PATENT NO. : 4,182,425

DATED : Jan. 8, 1980

INVENTOR(S) : William R. Garrett

It is certified that error appears in the above—identified patent and that said Letters Patent is hereby corrected as shown below:

Column 1, line 38: change "Huges" to -Hughes-.
Column 5, line 66: change "extend" to -extends-.
Column 7, line 22: Change "33a" to -33A-.
Column 8, line 7: after "0", insert a hyphen (-).
Column 9, line 35: change "290" to -490-.
Column 10, line 10: after "comprises", insert -a-.
Column 10, line 27: after "applies", change "to" to -of-.
Column 10, line 56: change "difference" to -differences-.
Column 15, line 57; change "8" to -44-
Column 16, line 45: after "socket" change "of" to -to-.
Column 16, line 49: change "15" to -46-.
Column 19, line 53: change "33" to -39-.
Column 19, line 62: change "shafts" to -shaft's-.
Column 21, line 40: change "46" to -51-.
Column 22, line 61: change "socket" to -sockets-.
Column 23, line 27: change "64" to -68-.
Column 23, line 42: change "portios" to -portions-.

UNITED STATES PATENT AND TRADEMARK OFFICE

CERTIFICATE OF CORRECTION

PATENT NO. : 4,182,425

DATED : Jan. 8, 1980

INVENTOR(S) : William R. Garrett

It is certified that error appears in the above—identified patent and that said Letters Patent is hereby corrected as shown below:

Column 24, line 4: change "dispoed" to -disposed-.
Column 25, line 21: after the first occurrence of "parts", insert -each-.

Column 1, line 52: change "MacCotchie" to -MacClatchie-.
Column 2, line 10: after "shows" insert -a-.
Column 2, line 11: after "dial", delete -a-.
Colimn 3, line 67: after "lubrication", insert a parenthesis -)-.
Column 4, line 2: after "roller", insert a clpsed parenthesis -)-.
Column 4, line 58: after "is", insert -a-.
Column 6, line 30: change "77" to -79-.
Column 6, line 34: delete "within" and insert -with one-.
Column 6, line 36: change "becomes" to -become-.
Column 6, line 36: delete "with" and insert --into--.
Column 7, line 22: change "rollers"to -roller-.

UNITED STATES PATENT AND TRADEMARK OFFICE

CERTIFICATE OF CORRECTION

PATENT NO. : 4,182,425 Page 3 of 3

DATED : Jan. 8, 1980

INVENTOR(S) : William R. Garrett

It is certified that error appears in the above—identified patent and that said Letters Patent is hereby corrected as shown below:

Col. 7, line 59: change "lend" to -tend-.
Col. 7, line 66: after "93A" insert a comma (,).
Col. 9, line 13: after "positions", delete the comma (,),
Col. 13, line 9: change "periphey" to -periphery-.
Col. 13, line 41: change "terminii" to -termini-.
Col. 13, line 50: after "angle", delete -to the perpendicular-.
Col. 15, line 61: after "including", delete "washer" and insert -a-.
Col.16, line 34: change "providding" to -providing-.
Col. 19, line 12: change "rooler" to -roller-.
Col. 20, line 23: change "tranfer" to -transfer-.
Col. 21, line 45: after "useful", insert -in-.
Col. 25, line 26: change "carbine" to -carbide-.

Signed and Sealed this

*Eighteenth* Day of *November 1980*

[SEAL]

*Attest:*

SIDNEY A. DIAMOND

*Attesting Officer*

*Commissioner of Patents and Trademark*